US006609822B1

(12) United States Patent
Tokoro et al.

(10) Patent No.: US 6,609,822 B1
(45) Date of Patent: Aug. 26, 2003

(54) RATE ADJUSTING METHOD OF MECHANICAL TIMEPIECES

(75) Inventors: Takeshi Tokoro, Chiba (JP); Koichiro Jujo, Chiba (JP); Masafumi Hoshino, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/913,836

(22) PCT Filed: Dec. 24, 1999

(86) PCT No.: PCT/JP99/07291

§ 371 (c)(1),
(2), (4) Date: Jan. 15, 2002

(87) PCT Pub. No.: WO01/48564

PCT Pub. Date: Jul. 5, 2001

(51) Int. Cl.[7] ..... G04B 17/20; G04B 17/04
(52) U.S. Cl. ..... 368/171; 368/175
(58) Field of Search ..... 368/127, 169, 368/170, 171, 175

(56) References Cited

U.S. PATENT DOCUMENTS 3,727,027 A * 4/1973 Kaiser et al.
3,813,872 A * 6/1974 Nakagawa et al.

FOREIGN PATENT DOCUMENTS

| | | |
|---|---|---|
| JP | 47-22768 | * 10/1972 |
| JP | 47-7772 | * 1/1973 |
| JP | 48-97570 | * 12/1973 |

* cited by examiner

*Primary Examiner*—Vit Miska
(74) *Attorney, Agent, or Firm*—Adams & Wilks

(57) ABSTRACT

According to a rate adjusting method, the movement of a mechanical timepiece is first assembled. The assembled movement is then disposed in a vertical position, and the rate is measured with respect to a plurality of vertical positions. On the basis of the result of this rate measurement, the magnitude and direction of the positional difference vector are calculated. On the basis of the result of this calculaton, the amount of weight to be added to or subtracted from the annular balance of the movement is calculated and the positions on the annular balance where this amount of weight is to be added to or to be subtracted from is calculated. Based on the results of these calculations, the amount of weight is added to or subtracted from the annular balance at the calculated positions.

14 Claims, 17 Drawing Sheets

RATE ADJUSTING METHOD OF MECHANICAL TIMEPIECES

BACKGROUND OF THE INVENTION

Field of the Invention

The present invention relates to a rate adjusting method of a mechanical type timepiece.

The invention particularly relates to a method of adjusting a rate of a mechanical timepiece by attaching a weight to a portion of a balance wheel or removing a portion of the balance wheel in a movement of a mechanical type timepiece.

Background Information

In a conventional mechanical type timepiece, as shown in FIG. 16 and FIG. 17, a movement (machine body) 1100 of a mechanical type timepiece is provided with a main plate 1102 constituting a base plate of the movement. A winding stem 1110 is rotatably integrated to a winding stem guide hole 1102*a* of the main plate 1102. A dial 1104 (shown by imaginary lines in FIG. 17) is attached to the movement 1100.

Generally, in both sides of the main plate, a side thereof having the dial is referred to as "back side" of the movement and a side opposed to the side having the dial is referred to as "front side" of the movement. A train wheel integrated to the "front side" of the movement is referred to as "front train wheel" and a train wheel integrated to the "back side" of the movement is referred to as "back train wheel".

By a switch apparatus including a setting lever 1190, a yoke 1192, a yoke spring 1194 and a setting lever jumper 1196, a position of the winding stem 1110 in an axis line direction thereof is determined. A winding pinion 1112 is rotatably provided to a guide shaft portion of the winding stem 1110. When the winding stem 1110 is rotated in a state in which the winding stem 1110 is disposed at a first winding stem position (0-th stage) mostly proximate to an inner side of the movement along a rotational axis line, the winding pinion 1112 is rotated via rotation of a clutch wheel. A crown wheel 1114 is rotated by rotation of the winding pinion 1112. A ratchet wheel 1116 is rotated by rotation of the crown wheel 1114. By rotating the ratchet wheel 1116, a mainspring 1122 contained in a barrel complete 1120 is wound up. A center wheel & pinion 1124 is rotated by rotation of the barrel complete 1120. An escape wheel & pinion 1130 is rotated via rotation of a fourth wheel & pinion 1128, a third wheel & pinion 1126 and the center wheel & pinion 1124. The barrel complete 1120, the center wheel & pinion 1124, the third wheel & pinion 1126 and the fourth wheel & pinion 1128 constitute a front train wheel.

An escapement & speed control apparatus for controlling rotation of the front train wheel includes a balance with hairspring 1140, the escape wheel & train 1130 and a pallet fork 1142. The balance with hairspring 1140 includes a balance stem 1140*a*, a balance wheel 1140*b* and a hairspring 1140*c*. Based on rotation of the center wheel & pinion 1124, an hour pinion 1150 is simultaneously rotated. A minute hand 1152 attached to the hour pinion 1150 displays "minute". The hour pinion 1150 is provided with a slip mechanism relative to the center wheel & pinion 1124. Based on rotation of the hour pinion 1150, an hour wheel 1154 is rotated via rotation of a minute wheel. An hour hand 1156 attached to the hour wheel 1154 displays "hour".

The barrel complete 1120 is supported by the main plate 1102 and a barrel bridge 1160 rotatably thereto. The center wheel & pinion 1124, the third wheel & pinion 1126, the fourth wheel & pinion 1128 and the escape wheel & pinion 1130 are supported by the main plate 1102 and a train wheel bridge 1162 rotatably thereto. The pallet fork 1142 is supported by the main plate 1102 and a pallet bridge 1164 rotatably thereto. The balance with hairspring 1140 is supported by the main plate 1102 and a balance with hairspring bridge 1166 rotatably thereto.

The hairspring 1140*c* is a thin plate spring in a helical (spiral) mode having a plural turn number. An inner end portion of the hairspring 1140*c* is fixed to a hairspring holder 1140*d* fixed to the balance stem 1140*a* and an outer end portion of the hairspring 1140*c* is fixed by screw fastening via a hairspring support 1170*a* attached to a stud support 1170 fixed to the balance with hairspring bridge 1166.

A regulator 1168 is rotatably attached to the balance bridge 1166. A hairspring bridge 1168*a* and a hairspring rod 1168*b* are attached to the regulator 1168. A portion of the hairspring 1140*c* proximate to the outer end portion is disposed between the hairspring bridge 1168*a* and the hairspring rod 1168*b*.

Generally, according to a conventional representative mechanical type timepiece, mainspring torque is reduced as a duration time period elapses by rewinding the mainspring from a state in which the mainspring is completely wound up (fully wound state). For example, the mainspring torque is about 27 g·cm in the fully wound state, becomes about 23 g·cm after 20 hours has elapsed from the fully wound state and becomes about 18 g·cm after 40 hours has elapsed from the fully wound state.

Generally, according to a conventional representative mechanical type timepiece, when mainspring torque is reduced, a swing angle of the balance with hairspring is also reduced. For example, when the mainspring torque falls in a range of 25 through 28 g·cm, the swing angle of the balance with hairspring is about 240 through 270 degrees and when the mainspring torque falls in a range of 20 through 25 g·cm, the swing angle of the balance with hairspring is about 180 through 240 degrees.

Here, "instantaneous rate" or "rate" is referred to as "value indicating gaining or losing of a mechanical type timepiece when 1 day has elapsed when assuming that the mechanical type timepiece is left for 1 day while maintaining state or environment of the swing angle of the balance with hairspring or the like when the rate is measured". The "rate" is designated by notation H.

For example, although in a conventional representative mechanical type timepiece, when a swing angle of a balance with hairspring falls in a range of about 200 through 240 degrees, the instantaneous rate is about 0 through 5 seconds/day (gaining of about 0 through 5 seconds per day), when the swing angle of the balance with hairspring is about 170 degrees, the instantaneous rate becomes about −20 seconds/day (losing of about 20 seconds per day).

Generally, according to the conventional mechanical type timepiece, with elapse of a duration time period by rewinding the mainspring from a fully wound state, the mainspring torque is reduced, the swing angle of the balance with hairspring is also reduced and accordingly, the instantaneous rate is retarded. Therefore, according to the conventional mechanical type timepiece, by estimating a delay of the timepiece after the duration time period has elapsed for 24 hours, the instantaneous rate when the main spring is brought into the fully wound state, is previously increased, and is previously adjusted such that the "rate" indicating gaining of the timepiece or losing of the timepiece per day becomes positive.

In a mechanical type timepiece, when assuming a state of attaching a dial, "flat attitude" in which the dial becomes horizontal and "vertical attitude" in which the dial becomes vertical are defined.

Further, according to the mechanical type timepiece, when the state attached with the dial is assumed, a direction directed from the center of the mechanical timepiece to 12 o'clock indicator of the dial is referred to as "12 o'clock direction", a direction directed from the center of the mechanical type timepiece to 3 o'clock indicator of the dial is referred to as "3 o'clock direction", a direction directed from the center of the mechanical type timepiece to 6 o'clock indicator of the dial is referred to as "6 o'clock direction" and a direction directed from the center of the mechanical type timepiece to 9 o'clock indicator of the dial is referred to as "9o'clock direction" (refer to FIG. 16).

Further, in the mechanical type timepiece, when assuming a state in which the dial is attached and the dial becomes vertical, an attitude in which the 12 o'clock indicator of the dial is disposed on an upper side is referred to as "attitude of 12 o'clock upper", an attitude in which 3 o'clock indicator of the dial is disposed on the upper side is referred to as "attitude of 3 o'clock upper", an attitude in which 6 o'clock indicator of the dial is disposed on the upper side is referred to as "attitude of 6 o'clock upper" and an attitude in which 9 o'clock indicator of the dial is disposed on the upper side is referred to as "attitude of 9 o'clock upper".

Further, it is known in the mechanical type timepiece that measured values of the "rate" differ with regard to four attitudes of the "attitude of 12 o'clock upper", "attitude of 3 o'clock upper", "attitude of 6 o'clock upper" and "attitude of 9 o'clock upper". Therefore, according to the mechanical type timepiece, the "rate" is measured with respect to the four attitudes and the rate of the mechanical type timepiece is adjusted such that the respective measured values of the "rate" satisfy a predetermined standard.

In the following explanation, the "rate when the mechanical type timepiece is disposed in the attitude of 12 o'clock upper" is referred to as "12 upper rate", the "rate when the mechanical type timepiece is disposed in the attitude of 3 o'clock upper" is referred to as "3 upper rate", the "rate when the mechanical type timepiece is disposed in the attitude of 6 o'clock upper" is referred to as "6 upper rate" and the "rate when the mechanical type timepiece is disposed in the attitude of 9 o'clock upper" is referred to as "9 upper rate".

Further, the "12 upper rate" is designated by notation Htw, the "3 upper rate" is designated by notation Hth, the "6 upper rate" is designated by notation Hsi and the "9 upper rate" is designated by notation Hni.

Conventionally, in adjusting the rate of such a mechanical type timepiece, the balance with hairspring 1140 is removed by manual operation from the movement (machine body) 1100 of the mechanical type timepiece which has been assembled once, a portion of the balance wheel is cut off by manual operation and the balance with hairspring 1140 is assembled again in the movement (machine body) 1100. Therefore, firstly, the rate is measured in the movement (machine body) 1100 of the mechanical type timepiece which has been assembled once, a portion of the balance wheel is cut off and thereafter, the rate is measured in the movement (machine body) 1100 reassembled with the balance with hairspring 1140.

Therefore, according to the conventional method of adjusting the rate of the mechanical type timepiece, operation of disassembling and assembling the balance with hairsprings 1140 is complicated, operation of measuring the rate is also complicated and there poses a problem in which enormous time and labor is taken in adjusting the rate.

Furthermore, according to the conventional method of adjusting the rate of the mechanical type timepiece, there is included a step of cutting a portion of the balance wheel by manual operation and therefore, it is difficult to adjust the rate with high accuracy.

Hence, it is an object of the invention to provide a method capable of adjusting a rate of a mechanical type timepiece without removing a balance with hairspring from a movement (machine body) of the mechanical type timepiece.

It is a further object of the invention to provide a method capable of adjusting a rate of a mechanical type timepiece in a short period of time and with extremely high accuracy.

SUMMARY OF THE INVENTION

The present invention is a rate adjusting method of a mechanical type timepiece comprising a movement constituted to include a mainspring constituting a power source of the mechanical type timepiece, a front train wheel rotated by a rotational force in rewinding the mainspring and an escapement & speed control apparatus for controlling rotation of the front train wheel, the escapement & speed control apparatus including a balance with hairspring alternately repeating right-hand rotation and left-hand rotation, an escape wheel and pinion rotated based on rotation of the front train wheel and a pallet fork for controlling rotation of the escape wheel & pinion based on operation of the balance with hairspring and the balance with hairspring including a hairspring, a balance stem and a balance wheel.

The rate adjusting method of a mechanical type timepiece according to the invention is characterized in including:

(a) a stage of assembling the movement of the mechanical type timepiece;

(b) a stage of measuring rates with regard to a plurality of "vertical attitudes" in a state in which the assembled movement is arranged in "vertical attitude";

(c) a stage of calculating the magnitude and the direction of an attitude difference vector based on a result of measuring the rates in the stage (b);

(d) a stage of calculating a weight amount to be added to the balance wheel or a weight amount to be removed from the balance wheel and calculating a position of the balance wheel to be added with the weight amount or to be removed of the weight amount based on a result of calculating the magnitude and the direction of the attitude difference vector in the stage (c); and (e) a stage of adding or removing the weight amount to or from the balance wheel based on a result of calculating the weight amount to be added to the balance wheel or to be removed from the balance wheel and calculating the position of the balance wheel to be added with the weight amount or to be removed of the weight amount in the stage (d).

According to the rate adjusting method of a mechanical type timepiece of the invention, it is preferable that the rates are measured in the stage (b) with respect to the four "vertical attitudes" of "attitude of 12 o'clock upper", "attitude of 3 o'clock upper", "attitude of 6 o'clock upper", and "attitude of 9 o'clock upper".

By using the method of the invention, the rate of the mechanical type timepiece can simply be adjusted without removing the balance with hairspring from the movement of the mechanical type timepiece.

Further, by using the method of the invention, the rate of the mechanical type timepiece can accurately be adjusted in a short period of time and with extremely high accuracy.

Further, according to the rate adjusting method of a mechanical type timepiece of the invention, it is preferable that the stage (d) includes a stage of calculating the weight amount to be added to the balance wheel and calculating the position of the balance wheel to be added with the weight amount based on the result of calculating the magnitude and the direction of the attitude difference vector at the stage (c), and the stage (e) includes a stage of attaching the weight amount on a surface of the balance wheel by using an ink jet projecting apparatus based on the result of calculating the weight amount to be added to the balance wheel and calculating the position of the balance wheel to be added with the weight amount in the stage (d).

In this way, by using the ink jet projecting apparatus, the weight amount can accurately be attached to the surface of the balance wheel in a short period of time and with extremely high accuracy.

Further, according to the rate adjusting method of a mechanical type timepiece of the invention, it is preferable that the stage (d) includes a stage of calculating the weight amount to be removed from the balance wheel and the position of the balance wheel to be removed of the weight amount based on the result of calculating the magnitude and the method of the attitude difference vector in the stage (c), and the stage (e) includes a stage of removing the weight amount from the balance wheel by using a laser emitting apparatus based on the result of calculating the weight amount to be removed from the balance wheel and calculating the position of the balance wheel to be removed of the weight amount in the stage (d).

In this way, by using the laser projecting apparatus, the weight amount can accurately be removed from the balance wheel in a short period of time and with extremely high accuracy.

Further, according to the rate adjusting method of the mechanical type timepiece of the invention, it is preferable that the stage (c) includes a stage of calculating the magnitude and the direction of the attitude difference vector with respect to a plurality of swing angles of the balance with hairspring.

By using the rate adjusting method including such a stage, the magnitude and the direction of the attitude difference vector can accurately be calculated.

DETAILED DESCRIPTION OF THE PREFERRED EMBODIMENTS

An explanation will be given as follows of a mode of carrying out a rate adjusting method of a mechanical type timepiece according to the invention in reference to the drawings.

(1) First Embodiment

Figure 1:
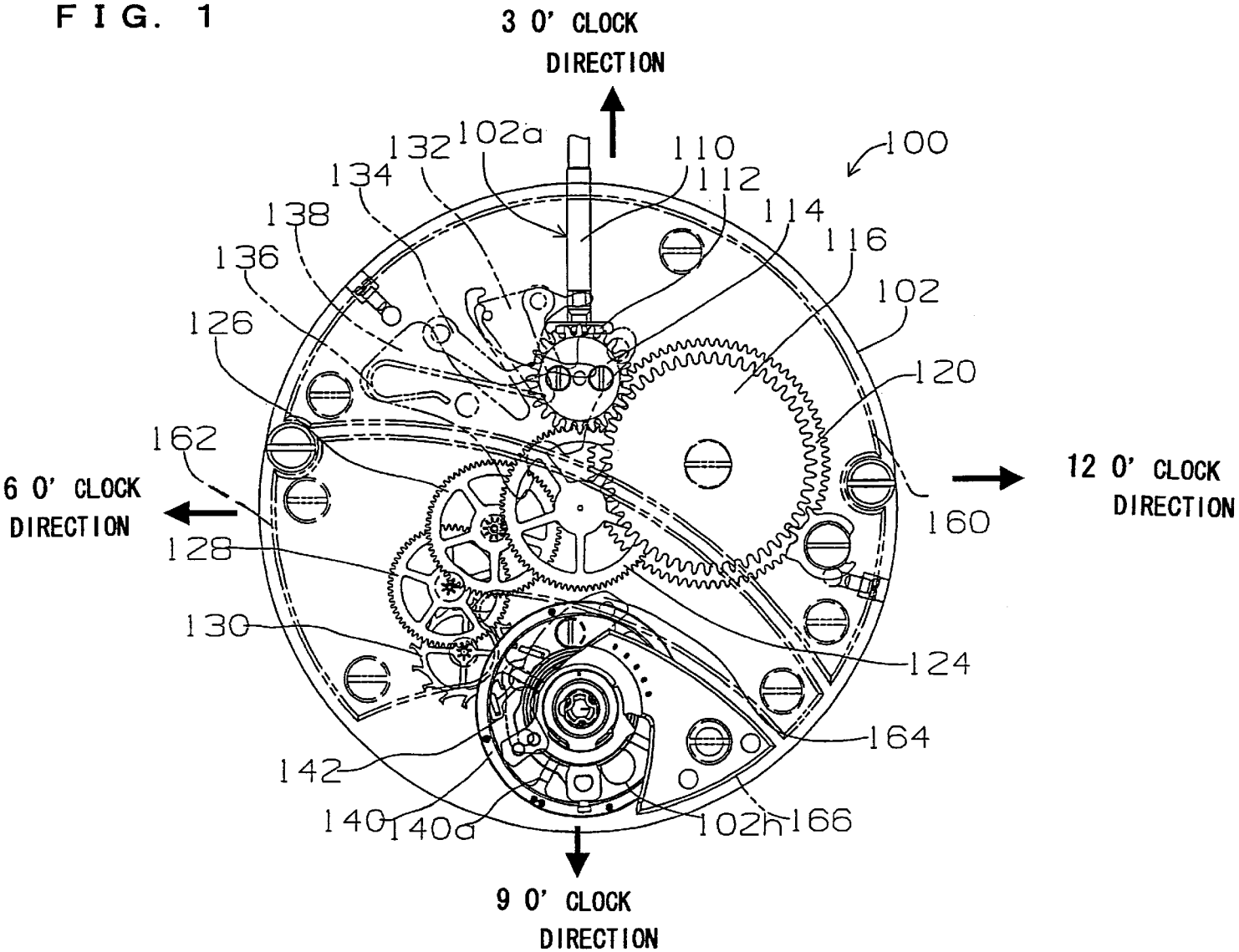
FIG. 1 is a plane view showing an outline shape of a front side of a movement adjusted with a rate by using a rate adjusting method of a mechanical type timepiece according to the invention in a first embodiment of a rate adjusting method of a mechanical type timepiece according to the invention (in FIG. one portions of parts are omitted and bridge members are designated by imaginary lines).
Figure 2:
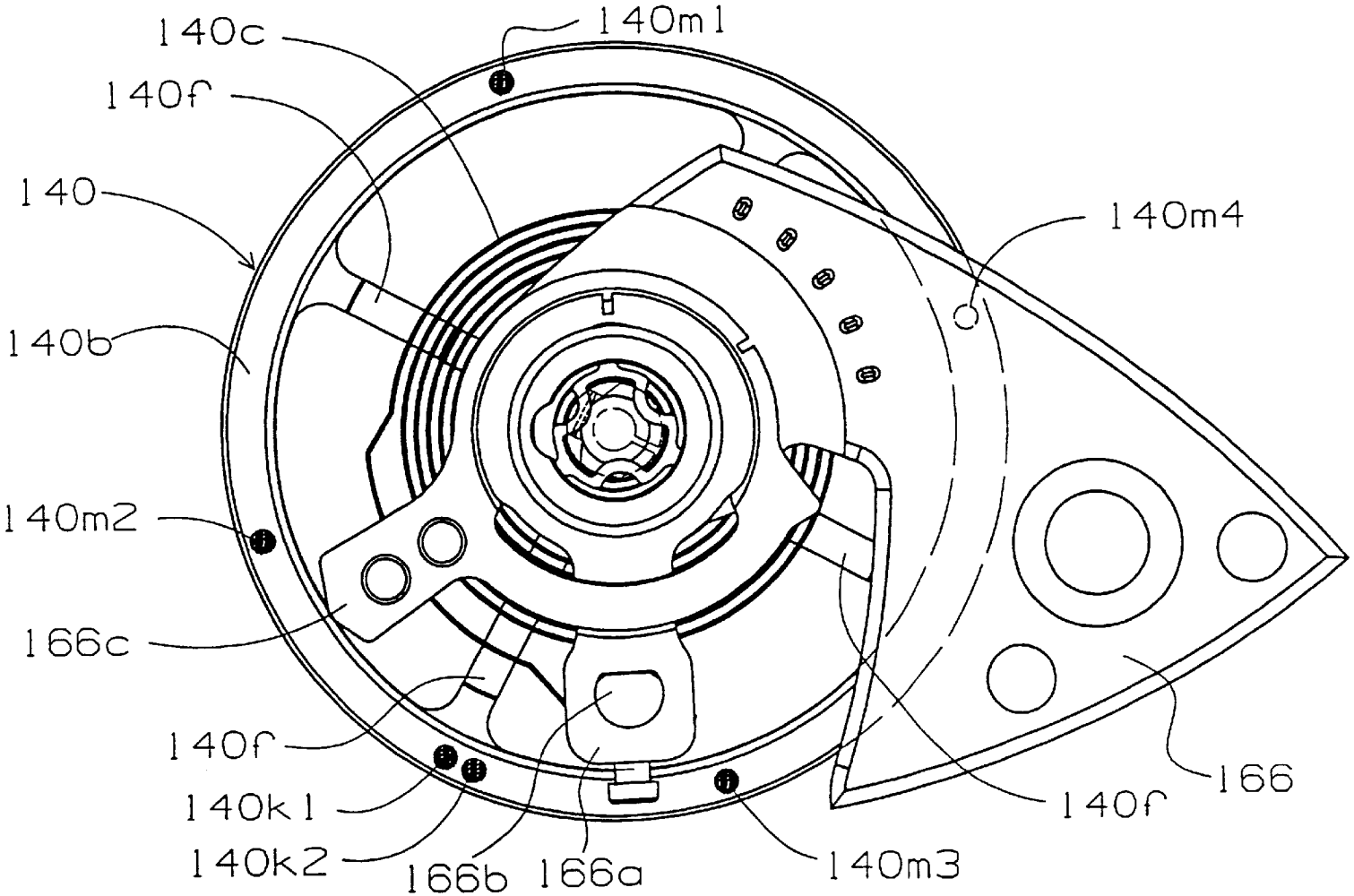
FIG. 2 is a plane view of enlarged portions showing portions of a balance bridge and a balance wheel of a movement in a movement adjusted with a rate by using the rate adjusting method of a mechanical type timepiece according to the invention in the first embodiment of the rate adjusting method of a mechanical type timepiece according to the invention.
Figure 3:
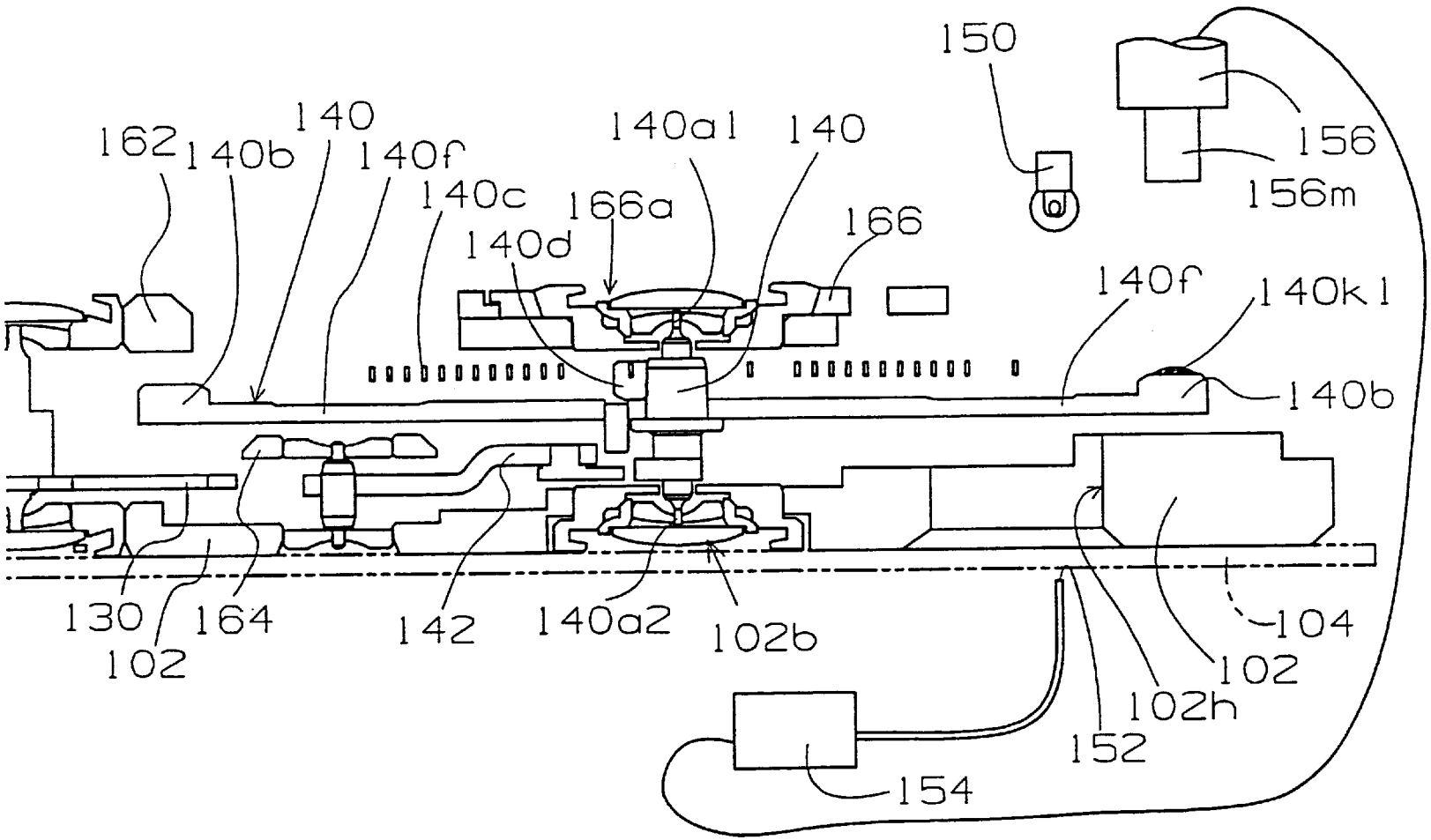
FIG. 3 is a sectional view of the enlarged portions showing the portions of the balance bridge and the balance wheel of the movement adjusted with the rate by using the adjusting method of a mechanical timepiece according to the invention by using the method of adjusting the rate of the mechanical type timepiece according to the invention in the first embodiment of the rate adjusting method of a mechanical type timepiece according to the invention.

In reference to FIG. 1 through FIG. 3, according to a first embodiment of a rate adjusting method of a mechanical type timepiece according to the invention, firstly, a movement (machine body) 100 of a mechanical type timepiece is assembled.

The movement 100 of the mechanical type timepiece includes a main plate 102 constituting a base plate of the movement. A winding stem 110 is rotatably integrated to a winding stem guide hole 102*a* of the main plate 102.

A dial 104 (shown by imaginary lines in FIG. 3) is attached to the movement 100 after adjusting a rate by using the rate adjusting method of the mechanical type timepiece according to the invention. The dial 104 is provided with, for example, 12 o'clock indicator, 3 o'clock indicator, 6 o'clock indicator and 9 o'clock indicator (none of the indicators is illustrated).

The winding stem 110 is provided with a square portion and a guide shaft portion. A clutch wheel (not illustrated) is integrated to the square portion of the winding stem 110. The clutch wheel is provided with a rotational axis line the same as the rotational axis line of the winding stem 110. That is, the clutch wheel is provided with a square hole and is provided to rotate based on rotation of the winding stem 110 by fitting the square hole to the square portion of the winding stem 110. The clutch wheel is provided with tooth A and tooth B. The tooth A is provided at an end portion of the clutch wheel proximate to the center of the movement. Tooth B is provided to an end portion of the clutch wheel proximate to an outer side of the movement.

The movement 100 is integrated with a switch apparatus for determining a position of the winding stem 110 in the axis line direction. The switch apparatus includes a setting lever 132, a yoke 134, a yoke spring 136 and a setting lever jumper 136. The position of the winding stem 110 in the rotational axis line is determined based on rotation of the setting lever 132. A position of the clutch wheel in the rotational axis line is determined based on rotation of the yoke 134. Based on rotation of the setting lever 132, the yoke 134 is positioned at two positions in a rotational direction.

A winding pinion 112 is rotatably integrated to the guide shaft portion of the winding stem 110. When the winding stem 110 is rotated in a state in which the winding stem 110 is disposed at a first winding stem position (0-th stage) mostly proximate to the inner side of the movement 100 along the rotational axis line direction, the winding pinion 112 is constituted to rotate via rotation of the clutch wheel. A crown wheel 114 is integrated to rotate by rotation of the winding pinion 112. A ratchet wheel 116 is integrated to rotate by rotation of the crown wheel 114.

The movement 100 is provided with a main spring (not illustrated) contained in a barrel complete 120 as a power source. The mainspring is fabricated by an elastic material having spring performance such as iron. It is constituted that the mainspring can be wound up by rotating the ratchet wheel 116.

A center wheel & pinion 124 is integrated to rotate by rotation of the barrel complete 120. A third wheel & pinion 126 is integrated to rotate based on rotation of the second wheel & pinion 124. A fourth wheel & pinion 128 is integrated to rotate based on rotation of the third wheel & pinion 126. An escape wheel & pinion 130 is integrated to rotate based on rotation of the fourth wheel & pinion 128. The barrel complete 120, the center wheel & pinion 124, the third wheel & pinion 126 and the fourth wheel & pinion 128 constitute a front train wheel.

The movement 100 is integrated with an escapement & speed control apparatus for controlling rotation of the front train wheel. The escapement & speed control apparatus includes a balance with hairspring 140 repeating to rotate in the right-hand direction and in the left-hand direction at a constant period, the escape wheel & pinion 130 rotated based on rotation of the front train wheel and a pallet fork 142 for controlling rotation of the escape wheel & pinion 130 based on rotation of the balance with hairspring 140.

The balance with hairspring 140 includes a balance stem 140*a*, a balance wheel 140*b* and a hairspring 140*c*. There are provided four balance arm portions 140*f* (referred to as "amida") for connecting the balance stem 140*a* and the balance wheel 140*b*. The number of the balance arm portions 140*f* may be 2, 3 or 4 or more.

The hairspring 140*c* is fabricated by an elastic material having spring performance such as "elinvar" or the like. That is, the hairspring 140*c* is fabricated by an elastically conductive metal material.

Based on rotation of the center wheel & pinion 124, an hour pinion (not illustrated) is simultaneously rotated. A minute hand (not illustrated) attached to the hour pinion is constituted to display "minute". The hour pinion is provided with a slip mechanism having a predetermined slip torque relative to the center wheel & pinion 124.

A minute wheel (not illustrated) is rotated based on rotation of the hour pinion. An hour wheel (not illustrated) is rotated based on rotation of the minute wheel. An hour hand (not illustrated) attached to the hour wheel is constituted to display "hour".

The barrel complete 120 is supported by the main plate 102 and a barrel bridge 160 rotatably thereto. The center wheel & pinion 124, the third wheel & pinion 126, the fourth wheel & pinion 128 and the escape wheel & pinion 130 are supported by the main plate 102 and a train wheel bridge 162 rotatably thereto. The pallet fork 142 is supported by the main plate 102 and a pallet bridge 164 rotatably thereto.

The balance with hairspring 140 is supported by the main plate 102 and a balance with hairspring bridge 166 rotatably thereto. That is, an upper mortise 140*a*1 of the balance stem 140*a* is supported by a balance upper bearing 166*a* fixed to the balance with hairspring bridge 166 rotatably thereto. The balance upper bearing 166*a* includes a balance upper hole jewel and a balance upper bridge jewel. The balance upper hole jewel and the balance upper bridge jewel are fabricated by an insulating material of ruby or the like.

The main plate 102 is provided with a balance measuring window portion 102*h* for measuring rotational operation of the balance arm portion 140*f* of the balance with hairspring 140. The balance arm portion 140*f* is rotated to traverse the balance measuring window portion 102*h*.

A lower mortise 140*a*2 of the balance stem 140*a* is rotatably supported by a balance lower bearing 102*b* fixed to the main plate 102. The balance lower bearing 102*b* includes a balance lower hole jewel and a balance lower bridge jewel. The balance lower hole jewel and the balance lower bridge jewel are fabricated by an insulating material of ruby or the like.

The hairspring 140*c* is a thin plate spring in a helical (spiral) mode having a plural turn number. An inner end portion of the hairspring 140*c* is fixed to a hairspring holder 140*d* fixed to the balance stem 140*a* and an outer end portion of the hairspring 140*c* is fixed by a screw via a hairspring support 166*b* attached to a stud support 166*a* rotatably fixed to the balance bridge 166. The balance with hairspring 166 is fabricated by a metallic electricity conductive material of brass or the like. The stud support 166*a* is fabricated by a metallic electricity conductive material of iron or the like.

A regulator 166*c* is rotatably attached to the balance with hairspring bridge 166.

Figure 4:
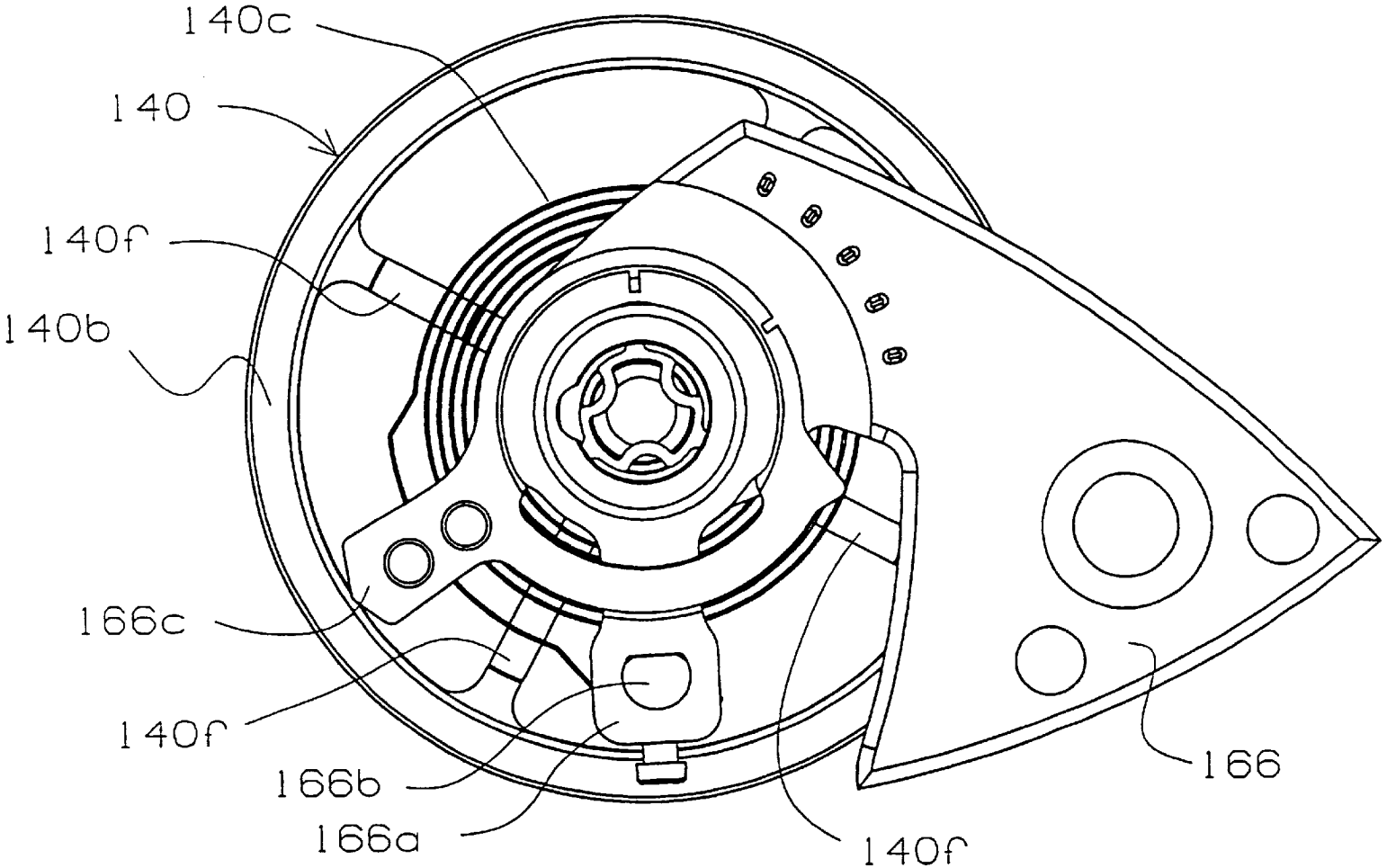
FIG. 4 is a plane view of the enlarged portions showing the portions of the balance bridge and the balance wheel before adjusting the rate in the first embodiment of the rate adjusting method of a mechanical type timepiece according to the invention.

The hairspring 140*c* is elongated and contracted in the radius direction of the hairspring 140*c* in accordance with a rotational angle rotated by the balance with hairspring 140. For example, in a state shown in FIG. 4, when the balance with spring 140 is rotated in the clockwise direction, the hairspring 140*c* is contracted in a direction directed to the center of the balance with hairspring 140 and in contrast thereto, when the balance with hairspring 140 is rotated in the counterclockwise direction, the hairspring 140*c* is expanded in a direction remote from the center of the balance with hairspring 140.

(2) Steps of Rate Adjusting Method of Mechanical Type Timepiece According to the Invention Next, an explanation will be given of steps of a rate adjusting method of a mechanical type timepiece according to the invention.

(2.1) Outline of Rate Adjusting Method of Mechanical Type Timepiece

An explanation will be given as follows of an outline of a rate adjusting method of a mechanical type timepiece.

Figure 6:
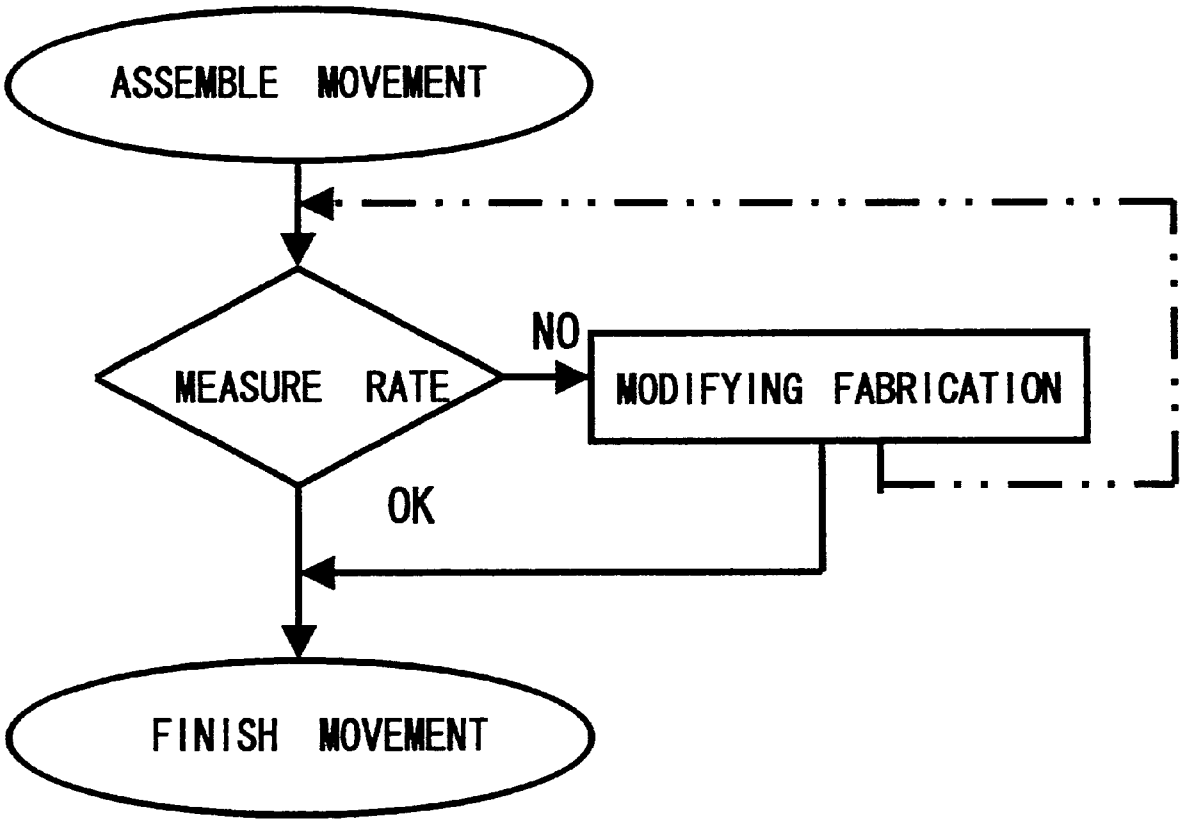
FIG. 6 is a flowchart showing outline steps of a method of adjusting a rate in an embodiment of the rate adjusting method of a mechanical type timepiece according to the invention.

According to a rate adjusting method of a mechanical type timepiece of the invention, in reference to FIG. 6, firstly, the movement 100 of the mechanical type timepiece is assembled. As mentioned above, according to the movement 100, the barrel complete 110, the crown wheel 114, the winding pinion 112, the ratchet wheel 116, the crown wheel 114, the switch apparatus, the front train wheel, the escapement & speed control apparatus, the hour pinion, the minute wheel, the hour wheel and so on are respectively operably integrated to the base plate 102 or the bridge members 160, 162 and 166.

As mentioned above, the escapement & speed control apparatus includes the balance with hairspring 140 alternately repeating clockwise rotation and counterclockwise rotation, the escape wheel & pinion 130 rotated based on rotation of the front train wheel and the pallet fork 142 for controlling rotation of the escape wheel & pinion 130 based on rotation of the balance with hairspring 140. The balance with hairspring 140 includes the balance stem 140*a*, the balance wheel 140*b* and the hairspring 140*c*.

Next, the rate of the mechanical type timepiece is measured by measuring states of operation of the balance with hairspring 140 in a plurality of attitudes in a state in which the assembled movement is arranged in "vertical attitude".

Measurement of the rate is carried out with regard to, for example, four attitudes of "attitude of 12 o'clock upper", "attitude of 3 o'clock upper", "attitude of 6 o'clock upper" and "attitude of 9 o'clock upper".

Further, "12 upper rate" Htw is measured by setting the mechanical type timepiece to attitude of 12 o'clock upper, "3 upper rate" Hth is measured by setting the mechanical type timepiece to attitude of 3 o'clock upper, "6 upper rate" Hsi is measured by setting the mechanical type timepiece to attitude of 6 o'clock upper and "9 upper rate" Hni is measured by setting the mechanical type timepiece to attitude of 9 o'clock upper.

Such measurement of rate may be carried out with regard to a plurality of "vertical attitudes" of two or more. The measurement of rate may be carried out in attitudes other than "attitude of 12 o'clock upper", "attitude of 3 o'clock upper", "attitude of 6 o'clock upper" and "attitude of 9 o'clock upper", for example, "attitude of 1 o'clock upper", "attitude of 2 o'clock upper", "attitude of 4 o'clock upper", "attitude of 5 o'clock upper", "attitude of 7 o'clock upper", "attitude of 8 o'clock upper", "attitude of 10 o'clock upper", "attitude of 11 o'clock upper" and so on.

That is, measurement of rate may be carried out with regard to a plurality of attitudes in the above-described 12 "vertical attitudes".

Next, when it is necessary to carry out modifying fabrication with respect to the balance wheel from a result of measurement of the rate, magnitude and direction of an attitude difference vector are calculated based on the result of measurement of the rate.

Next, based on a result of calculating the magnitude and the direction of the attitude difference vector, a weight amount to be added to the balance wheel or a weight amount to be removed from the balance wheel is calculated and a position of the balance wheel to be added with the weight amount or a position of the balance wheel to be removed of the weight amount is calculated.

Next, based on the calculation result produced by calculating the weight amount to be added to the balance wheel or the weight amount to be removed from the balance wheel and the position of the balance wheel to be added with the weight amount or the position of the balance wheel to be removed of the weight amount, there is carried out modifying fabrication such that the weight amount is added to the balance wheel or the weight amount is removed from the balance wheel.

When it is not necessary to carry out the modifying fabrication with respect to the balance wheel from the measurement result of the rate, the movement is finished in the state.

As a modified example, as shown by an imaginary line in FIG. 6, after carrying out the modifying fabrication with respect to the balance wheel, the rate of the mechanical type timepiece may be measured again and it may be confirmed whether the modifying fabrication is further needed with respect to the balance wheel.

(2.2) Adjustment of Swing Angle of Balance with Hairspring

An explanation will be given as follows of detailed content of the rate adjusting method of the mechanical type timepiece.

According to the invention, the magnitude and the direction of the attitude difference vector are calculated with regard to a plurality of swing angles of the balance with hairspring.

Figure 7:
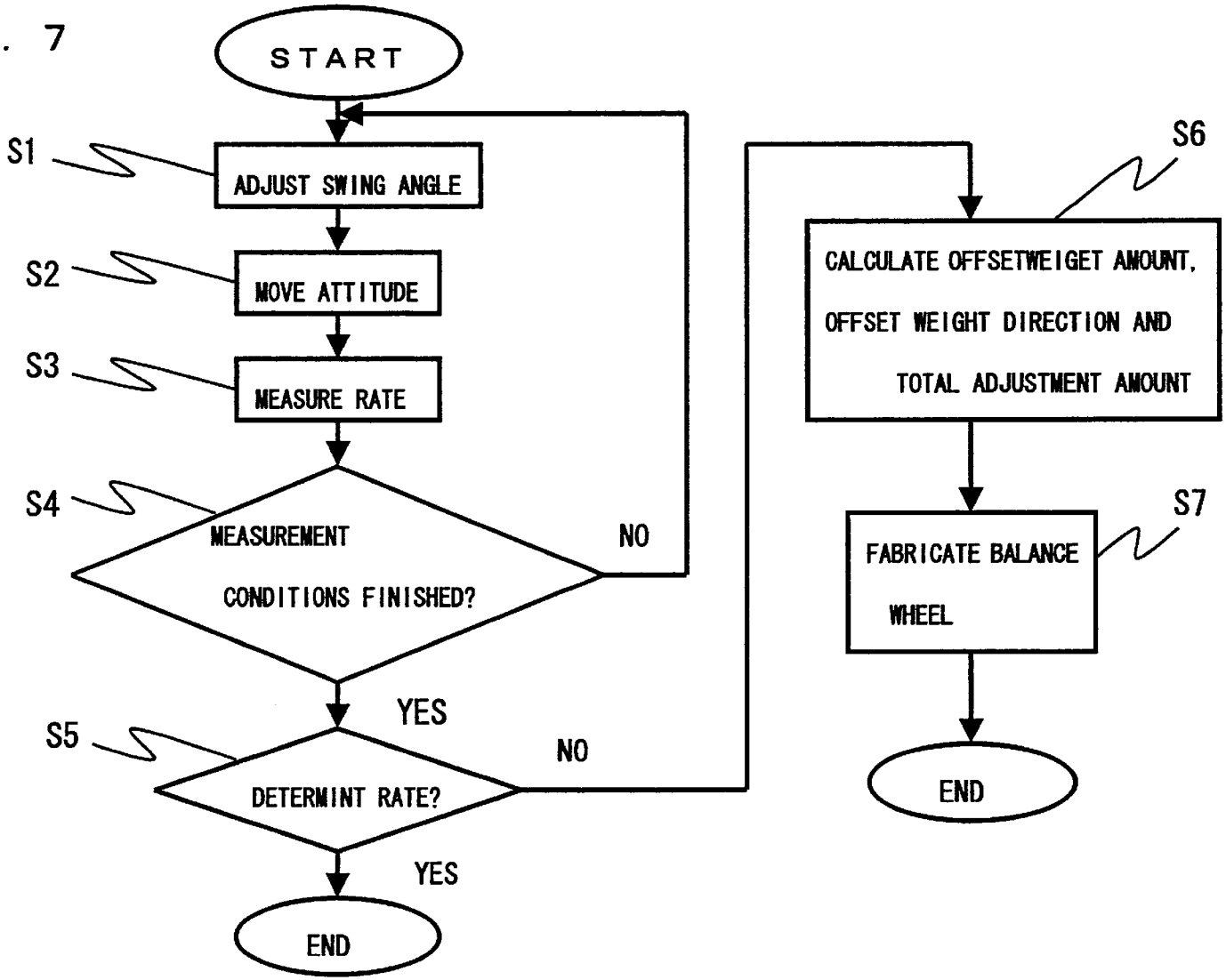
FIG. 7 is a flowchart showing details of steps of adjusting a rate in the embodiment of the rate adjusting method of a mechanical type timepiece according to the invention.

In reference to FIG. 7, the swing angle of the balance with hairspring is adjusted in a state in which the movement of the mechanical type timepiece is arranged in "flat attitude" (stage S1).

Adjustment of the swing angle of the balance with hairspring can be carried out by bringing a gear provided outside of the movement in mesh with the ratchet wheel, winding up the mainspring and measuring the turn number of the mainspring.

Or, the adjustment of the swing angle of the balance with hairspring can be carried out by measuring operation of the balance with hairspring while winding up the mainspring by using an apparatus of measuring operation of a balance with hairspring, mentioned later.

Figure 5:
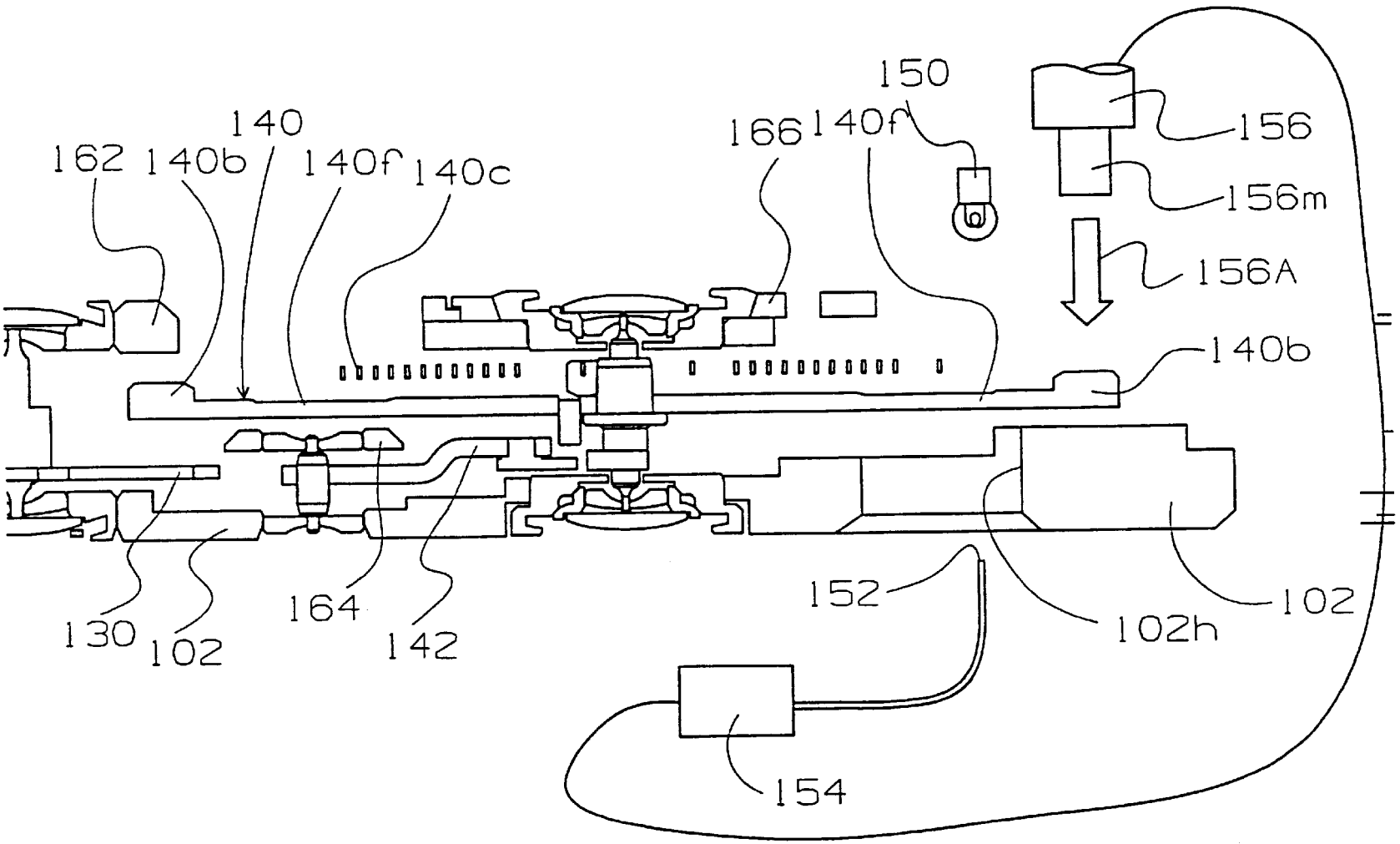
FIG. 5 is a sectional view of the enlarged portions showing the portions of the balance bridge and the balance wheel before adjusting the rate in the first embodiment of the rate adjusting method of a mechanical type timepiece according to the invention.

In reference to FIG. 5, a light source 150 is arranged to irradiate the balance arm portion 140*f*. A light receiving portion 152 is provided for receiving light of irradiating the balance arm portion 140*f*. Therefore, the balance arm portion 140*f* is operated between the light source 150 and the light receiving portion 152. When the balance arm portion 140*f* is disposed between the light source 150 and the light receiving portion 152, light irradiated by the light source 150 is blocked by the balance arm portion 140*f* and is not incident on the light receiving portion 152. In contrast thereto, when the balance arm portion 140*f* is not present between the light source 150 and the light receiving portion 152, the light irradiated by the light source 150 is incident on the light receiving portion 152. The light receiving portion 152 is constituted by, for example, an optical fiber, CCD, or a diode or the like.

The light receiving portion 152 is connected with a balance with hairspring operation measuring apparatus 154. The balance with hairspring operation measuring apparatus 154 is provided for calculating the swing angle of the balance with hairspring 140 by measuring operation of the balance arm portion 140*f*.

The balance with hairspring operation measuring apparatus 154 is previously stored with a relationship between a period of light incident on the light receiving portion 152 and the swing angle of the balance with hairspring. Therefore, calculation of the swing angle of the balance with hairspring 140 can be carried out by using the period of light incident on the light receiving portion 152.

The swing angle of the balance with hairspring in the state of arranging the movement in "flat attitude" set for calculating the magnitude and the direction of the attitude difference vector, is constituted by a plurality of angles. For example, the swing angle of the balance with hairspring includes at least 150 degrees and 250 degrees. The swing angle of the balance with hairspring may include other angle or may include an angle of 160 degrees, 180 degrees, 200 degrees, 220 degrees, 240 degrees or the like.

(2.3) Measurement of "Rates" with Regard to Four Attitudes

According to the method of the invention, before measuring "rate", attitude of the assembled movement is moved (stage S2 of FIG. 7).

Measurement of "rates" is carried out with regard to four attitudes of "attitude of 12 o'clock upper", "attitude of 3 o'clock upper", "attitude of 6 o'clock upper" and "attitude of 9 o'clock upper" in the state in which the assembled movement is arranged in "vertical attitude" (stage S3 of FIG. 7).

It is determined whether the stage of measuring "rates" by arranging the assembled movement in previously determined all "vertical attitudes", has been finished (stage S4 of FIG. 7). When the stage of carrying out measurement of "rate" has not been finished, the operation returns to the stage S4 and measurement of "rates" is carried out by arranging the assembled movement in successive "vertical attitude". When all the stage of carrying out measurement of "rate" has been finished, the operation proceeds to successive stage S5.

Figure 9:
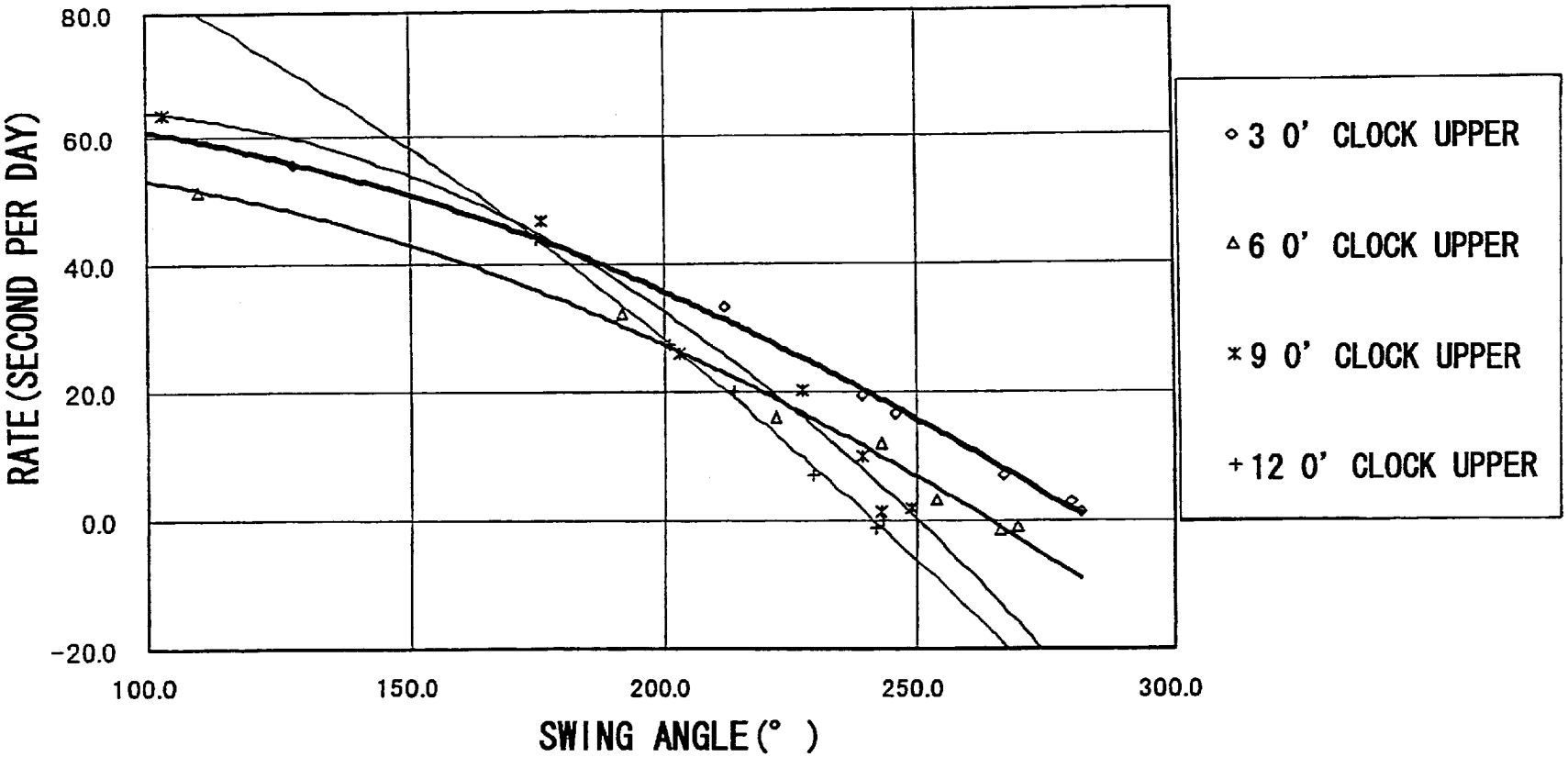
FIG. 9 is a graph showing an outline relationship between a swing angle of a balance with hairspring and rates in four attitudes before adjusting the rates in a mechanical type timepiece a rate of which is to be adjusted by using the rate adjusting method of a mechanical type timepiece according to the invention.

In reference to FIG. 9, there is shown an example of a result of measuring "rates" of the assembled movement. It tells that with a change of the swing angle of the balance with hairspring from 100 degrees to 250 degrees, "rate" of "attitude of 12 o'clock upper" is changed from about +87 seconds/day to about −7 seconds/day, "rate" of "attitude of 3 o'clock upper" is changed from about +60 seconds/day to about +15 seconds/day, "rate" of "attitude of 6 o'clock upper" is changed from about +52 seconds/day to about +8 seconds/day and "rate" of "attitude of 9 o'clock upper" is changed from about +64 seconds/day to about 0 second/day.

When such a result of measuring "rates" falls within the standard of rate of the mechanical type timepiece, the attitude difference satisfies the standard and accordingly, it is determined that the rate adjustment is not necessary (stage S5 of FIG. 7). In this case, operation of rate adjustment is finished.

When such a result of measuring "rates" exceeds the standard of rate of the mechanical type timepiece, the attitude difference does not satisfy the standard and accordingly, it is determined that rate adjustment is necessary and the operation proceeds to successive stage S6.

(2.4) Calculation of Total Adjustment Amount and Offset Weight Amount

In reference to FIG. 7, when rate adjustment is determined to be necessary, total adjustment weight and offset weight amount of the balance with hairspring are calculated (stage S6 of FIG. 7).

At this stage, firstly, the offset weight amount of the balance with hairspring is calculated by using the measurement result of "rates". A value of the attitude difference vector UB when the swing angle of the balance with hairspring is 150 degrees, is calculated by using Equation (1), as follows.

$$UB=\sqrt{(\mathrm{Htw}-\mathrm{Hsi})^2+(\mathrm{Hth}-\mathrm{Hni})^2} \qquad \text{Equation (1)}$$

where UB: attitude difference vector, Htw: rate of attitude of 12 o'clock upper, Hth: rate of attitude of 3 o'clock upper, Hsi: rate of attitude of 6 o'clock upper, Hni: rate of attitude of 9 o'clock upper.

Further, in the mechanical type timepiece, when a total oscillation number of the balance with hairspring in 24 hours is set, the value of the attitude difference vector UB is shown by Equation (2), as follows.

$$UB=\frac{m^*r^*Kb}{I} \qquad \text{Equation (2)}$$

where UB: attitude difference vector, m: offset weight amount of the balance with hairspring, r: position of attaching ink to balance wheel (distance from center of balance wheel), Kb: total oscillation number of balance with hairspring in 24 hours, I: moment of inertia of balance wheel.

Here, in the mechanical type timepiece to be measured, the value I of the moment of inertia of the balance wheel and the position "r" for attaching ink to the balance wheel (for example, radius of a middle portion between an outer diameter and an inner diameter of balance wheel) are previously determined. Further, in the mechanical type timepiece to be measured, the total oscillation number Kb of the balance with hairspring during 24 hours is previously determined. Therefore, by using Equation (1) and Equation (2), the offset weight amount "m" of the balance with hairspring can be calculated.

Figure 8:
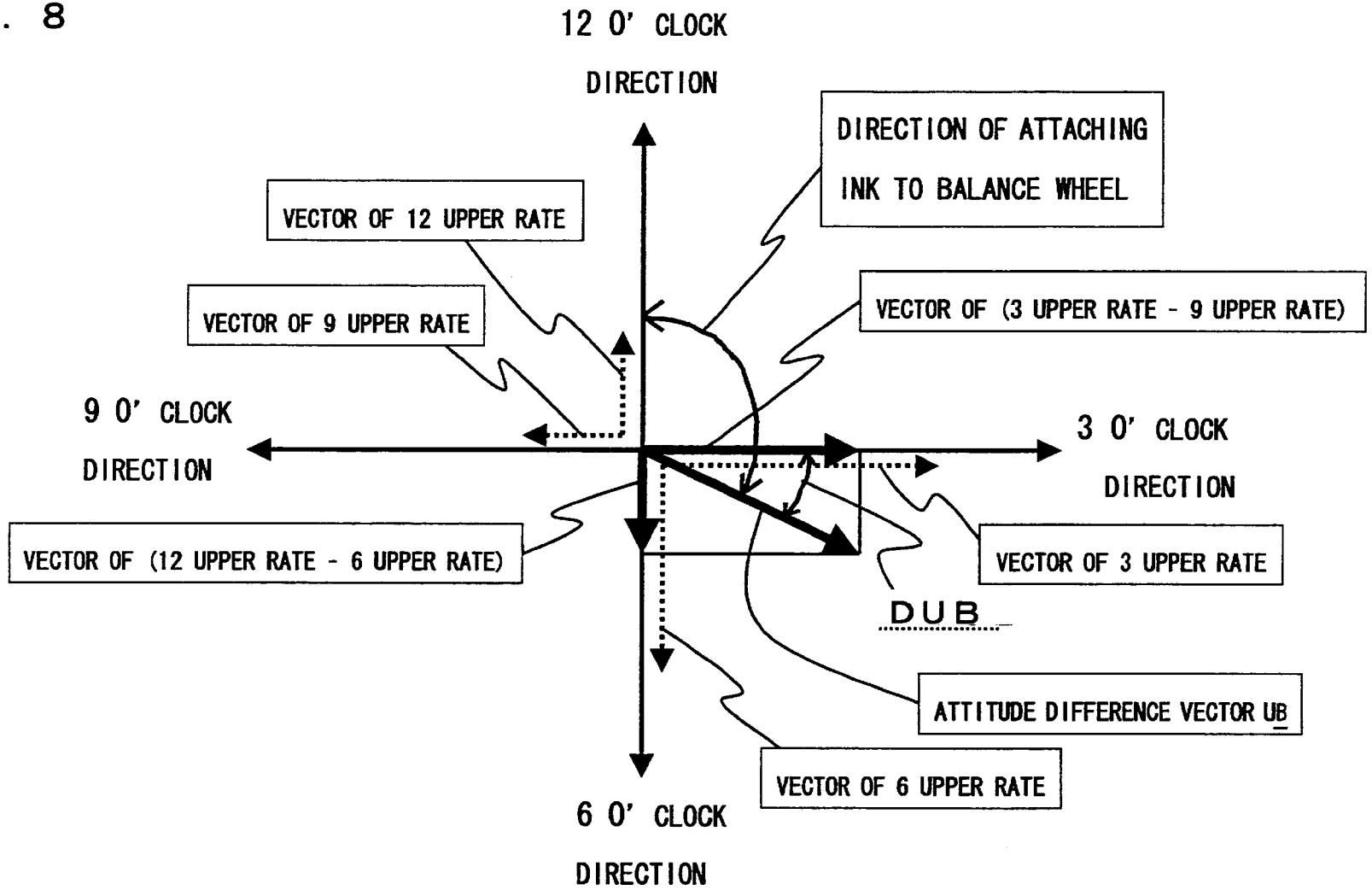
FIG. 8 is a diagram showing the principle of the steps of adjusting the rate in the embodiment of the rate adjusting method of a mechanical type timepiece according to the invention.

Here, in reference to FIG. 8, vector of 3 upper rate is written in the abscissa in positive direction (right direction) and vector of 9 upper rate is written on the abscissa in negative direction (left direction). Further, vector of 12 upper rate is written on the ordinate in positive direction (upper direction) and vector of 6 upper rate is written on the ordinate in negative direction (lower direction) (these four vectors are designated by dotted lines in FIG. 8).

Next, vector of (3 upper rate−9 upper rate) is written on the abscissa and vector of (12 upper rate−6 upper rate) is written on the ordinate (these two vectors are designated by bold lines in FIG. 8).

The attitude difference vector UB is represented by a vector synthesized with the vector of (3 upper rate−9 upper rate) and vector of (12 upper rate−6 upper rate) (the attitude difference vector UB is designated by a very bold line in FIG. 8).

Therefore, an angle DUB of the attitude difference vector UB with regard to the abscissa is shown by Equation (3), as follows.

$$DUB = \tan^{-1}\frac{Htw - Hsi}{Hth - Hni} \qquad \text{Equation (3)}$$

where DUB: direction of attitude difference vector (with 3 o'clock direction as reference).

As shown in FIG. 8, a direction of attaching ink to the balance wheel is designated by an angle in right-hand direction (clockwise direction) with 12 o'clock direction of the movement of the mechanical type timepiece as a reference when an oscillation jewel enters a sword tip of the pallet fork, that is, the balance with hairspring is brought into a middle state of rotation between left-hand direction and right-hand direction.

Further, also in the case in which rates are measured in other vertical attitudes, vectors of the rates in the respective vertical attitudes are illustrated in directions directed by the attitudes and a vector synthesized with the vectors of the respective rates is calculated, thereby, the attitude difference vector can be calculated by a method similar to the above-described method.

Further, when it is determined that the rate adjustment is necessary, the total adjustment amount of the balance with hairspring is calculated. As shown in FIG. 9, the total adjustment amount Zc of the balance with hairspring can be calculated based on the data of a preparatory experiment by using "inclination" and "segment" of a straight line produced by connecting an average value of the rates of four attitudes when the swing angle of the balance with hairspring is 150 degrees and an average value of the rates of four attitudes when the swing angle of the balance with hairspring is 250 degrees.

Here, "segment" is defined by coordinate values when a certain straight line intersects with a reference axis line (for example, vertical axis line Y axis). "Inclination" is defined by tangent of an angle of inclination when the certain straight line intersects with a reference axis line (for example, horizontal axis line X axis). For example, in the case of a straight line y=ax+b, "a" designates "inclination" and "b" designates "segment".

That is, the preparatory experiment is carried out with regard to a sample of a kind the same as that of a mechanical type timepiece the rate of which is to be adjusted and there is calculated a relationship between inclination and segment of a straight line produced by connecting an average value of rates of four attitudes when the swing angle of the balance with hairspring is 150 degrees and an average value of rates of four attitudes when the swing angle of the balance with hairspring is 250 degrees, and the total adjustment amount of the balance with hairspring.

That is, generally, it is known by experiment in a mechanical type timepiece that accuracy of the timepiece (values of rates of four attitudes in various swing angles of balance with hairspring) is excellent when a wind up angle of the hairspring is 90 degrees and 270 degrees.

Here, when an angle in the circumferential direction is defined with the rotational center of the balance with hairspring as an original point, "wind up angle" designates an angle in the circumferential direction to a position where the hairspring rod is present with a position at which the hairspring is fixed to the hairspring holder as a reference.

Therefore, by using the inclination and the segment of the straight line calculated as described above, the wind up angle of the hairspring is predicted. Next, in the mechanical type timepiece, there is calculated a length of the hairspring for constituting 90 degrees or 270 degrees of the wind up angle of the hairspring (adjustment length). Next, there is calculated a difference (length difference) between the length of the hairspring (adjustment length) and actual length of the hairspring in the mechanical type timepiece (actual length). Next, there is calculated a difference (difference of moment of inertia) of the balance with hairspring in correspondence with the difference of length (length difference). Further, by using the difference of moment of inertia, the total adjustment amount of the balance with hairspring can be calculated.

Therefore, according to the method, previously, it is necessary to carry out preparatory experiment with regard to a sample of a kind the same as that of the mechanical type timepiece the rate of which is to be adjusted and to calculate a relationship between the wind up angle of the hairspring and values of rates of four attitudes in various swing angles of the balance with hairspring.

According to the invention, previously, there is carried out preparatory experiment with regard to a sample of a kind the same as that of the mechanical type timepiece the rate of which is to be adjusted and by using the result, the total adjustment amount of the balance with hairspring is determined.

(2.5) Attachment of Ink to Balance Wheel

Next, an explanation will be given of a stage of attaching ink to the balance wheel.

In reference to FIG. 5, an ink jet projecting apparatus 156 is arranged such that a front end portion of an ink jet projecting nozzle 156*n* is opposed to the balance wheel 140*b* in order to attach a predetermined amount of ink to a surface of the balance wheel 140*b* as shown by an arrow mark 156A. The ink jet projecting apparatus 156 is arranged such that the ink jet projecting apparatus 156 is connected to the balance with hairspring operation measuring apparatus 154 and can project a predetermined amount of ink to the balance wheel 140*b* by inputting an operational signal outputted from the balance with hairspring operation measuring apparatus 154.

When rate adjustment is determined to be necessary, by using the ink jet projecting apparatus 156, ink having weight in correspondence with the result of calculating the offset weight amount, is attached at a position of the balance wheel in correspondence with the result of calculating the direction of attaching the ink to the balance wheel (stage S7 of FIG. 7).

Further, as shown by the following Equation (4), in order to adjust the total adjustment amount of the balance with hairspring, ink in correspondence with a calculation result Wf of an amount of ink to be attached to four portions of the balance wheel, is attached to four portions thereof spaced apart by 90 degrees of the balance wheel.

$$Wf = \frac{Zc - m}{4} \qquad \text{Equation (4)}$$

where wf: amount of ink to be attached to four portions of balance with hairspring, Zc: total adjustment amount, m: offset weight amount of balance wheel.

According to the first embodiment of the rate adjusting method of a mechanical type timepiece of the invention, there is included the stage of attaching ink to four portions of the balance wheel and therefore, the balance with hairspring is fabricated such that weight thereof is lighter than an aimed value in view of design.

Further, according to the first embodiment of the rate adjusting method of a mechanical type timepiece of the invention, in order to adjust the total adjustment amount of the balance with hairspring, portions of the balance with hairspring to be attached with ink are four portions thereof constituting point symmetry with the center of the balance wheel as its center, however, portions of the balance wheel to be attached with ink may be a plurality of portions constituting point symmetry with center of the balance wheel as its center, for example, the portions may be two portions constituting point symmetry with the center of the balance wheel as its center, may be three portions constituting point symmetry with the center of the balance wheel as its center or the portions may be portions of 4 or more constituting point symmetry with the center of the balance wheel as its center.

In reference to FIG. 2, ink **140*k*1 and 140*k*2 having a weight in correspondence with the calculation result of the offset weight amount of the balance with hairspring are attached to the balance wheel 140*b*. Position(s) for attaching ink having a weight in correspondence with the calculation result of the offset weight amount of the balance with hairspring to the balance wheel 140*b*, may be one portion or may be a plurality of portions. When the amount of attaching ink to the balance wheel 140*b* is large, it is preferable to attach ink at a plurality of portions of the balance wheel 140*b***.

Further, in order to adjust the total adjustment amount of the balance with hairspring, ink **140*m*1, 140*m*2, 140*m*3 and 140*m*4** (designated by dotted lines) having a weight in correspondence with the calculation result of an amount of ink to be attached to four portions of the balance wheel, is adhered at the 4 positions spaced apart by respective 90 degrees of the balance wheel.

FIG. 1 shows the movement of the mechanical type timepiece after the rate adjustment is carried out by the first embodiment of the rate adjusting method of the mechanical type timepiece according to the invention in this way.

According to an experiment using the rate adjusting method of the mechanical type timepiece of the invention, the offset weight amount of the balance with hairspring is about 0.1 mg and the direction of attaching ink having a weight in correspondence with the calculation result of the offset weight amount is about 120 degrees in the example shown in FIG. 1. Further, the total adjustment amount of the balance with hairspring is 0.3 mg.

Figure 10:
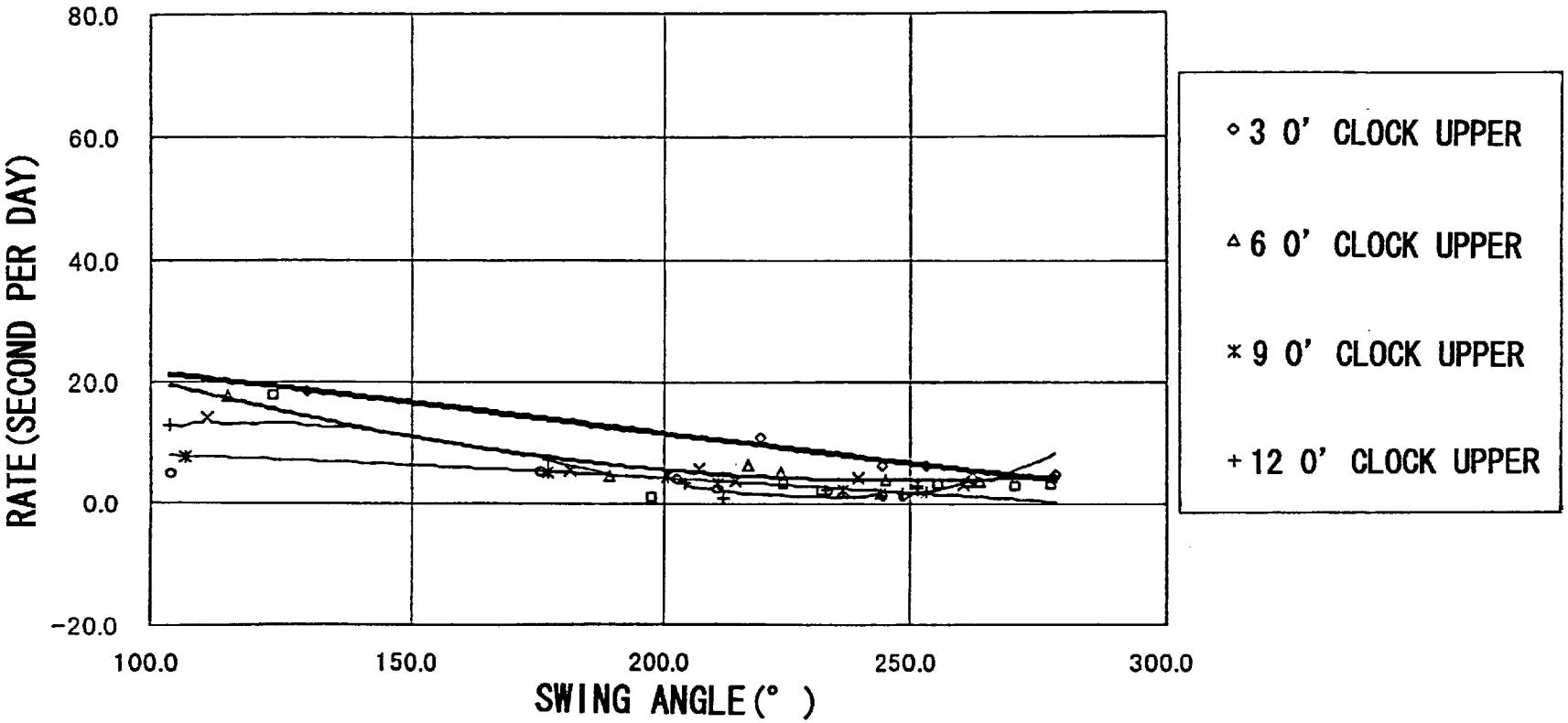
FIG. 10 is a graph showing an outline relationship between a swing angle of a balance with hairspring and rates in four attitudes in a mechanical type timepiece the rate of which has been adjusted by using the rate adjusting method of a mechanical type timepiece according to the invention.
Figure 11:
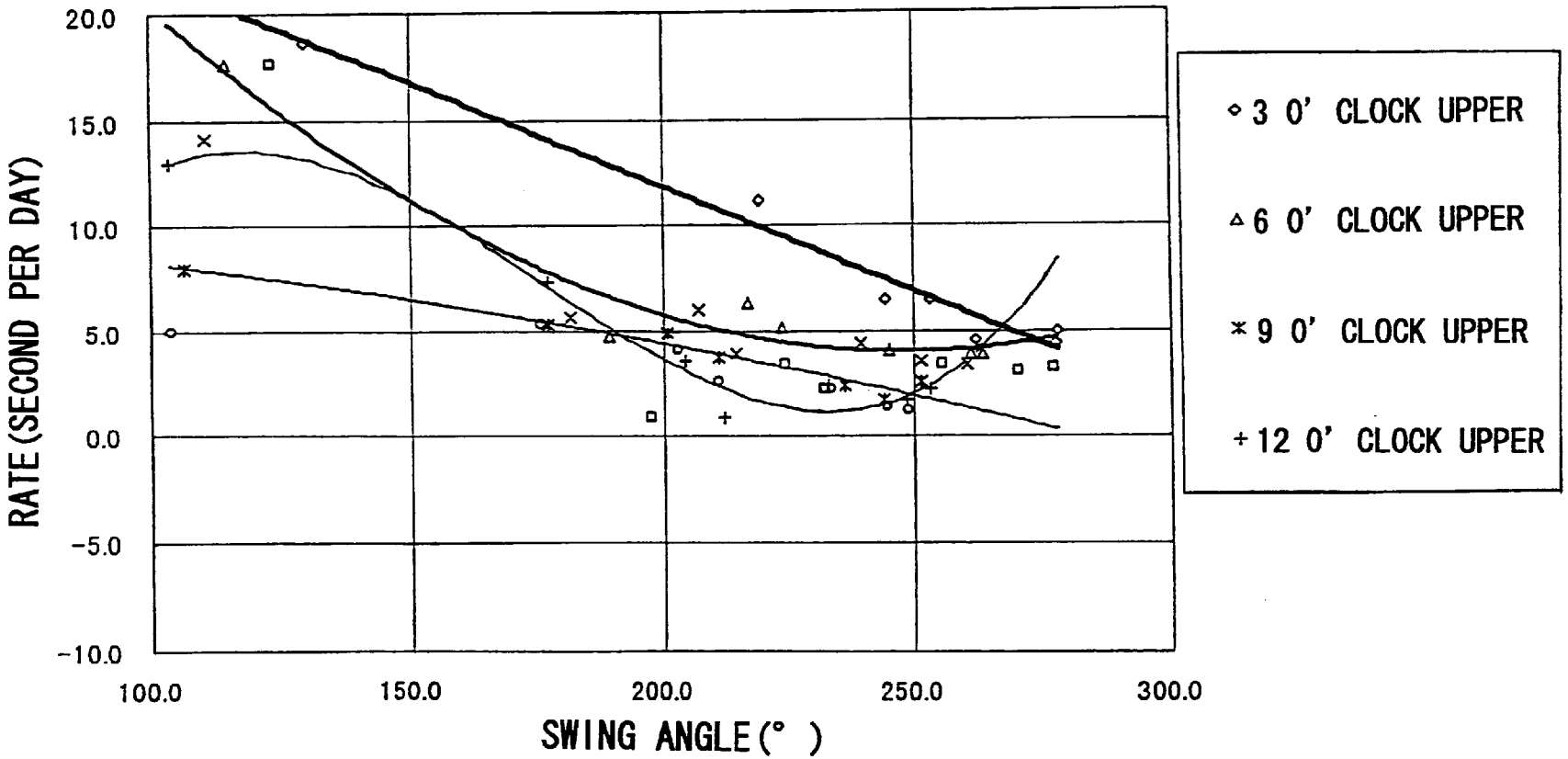
FIG. 11 is a graph showing a detailed relationship between the swing angle of the balance with hairspring and the rates in the four attitudes in the mechanical type timepiece the rate of which has been adjusted by using the rate adjusting method of a mechanical type timepiece according to the invention.

In reference to FIG. 10 and FIG. 11, there is shown an example of a result of measuring "rates" of the movement after the rate adjustment has been carried out by the first embodiment of the rate adjusting method of the mechanical type timepiece according to the invention. It tells that with change of the swing angle of the balance with hairspring from 100 degrees to 250 degrees, "12 upper rate" is changed from about +13 seconds/day to about +2 seconds/day, "3 upper rate" is changed from about +22 seconds/day to about +3 seconds/day, "6 upper rate" is changed from about +20 seconds/day to about +4 seconds/day and "9 upper rate" is changed from about +8 seconds/day to about 2 seconds/day.

It is known that such a result of measuring "rates" falls within the standard of the rate of the mechanical type timepiece.

(3) Second Embodiment

An explanation will be given as follows of a second embodiment of a rate adjusting method of a mechanical type timepiece according to the invention. In the following explanation, a description will mainly be given of a point in which the second embodiment of the rate adjusting method of a mechanical type timepiece of the invention differs from the first embodiment of the rate adjusting method of a mechanical type timepiece of the invention.

Figure 12:
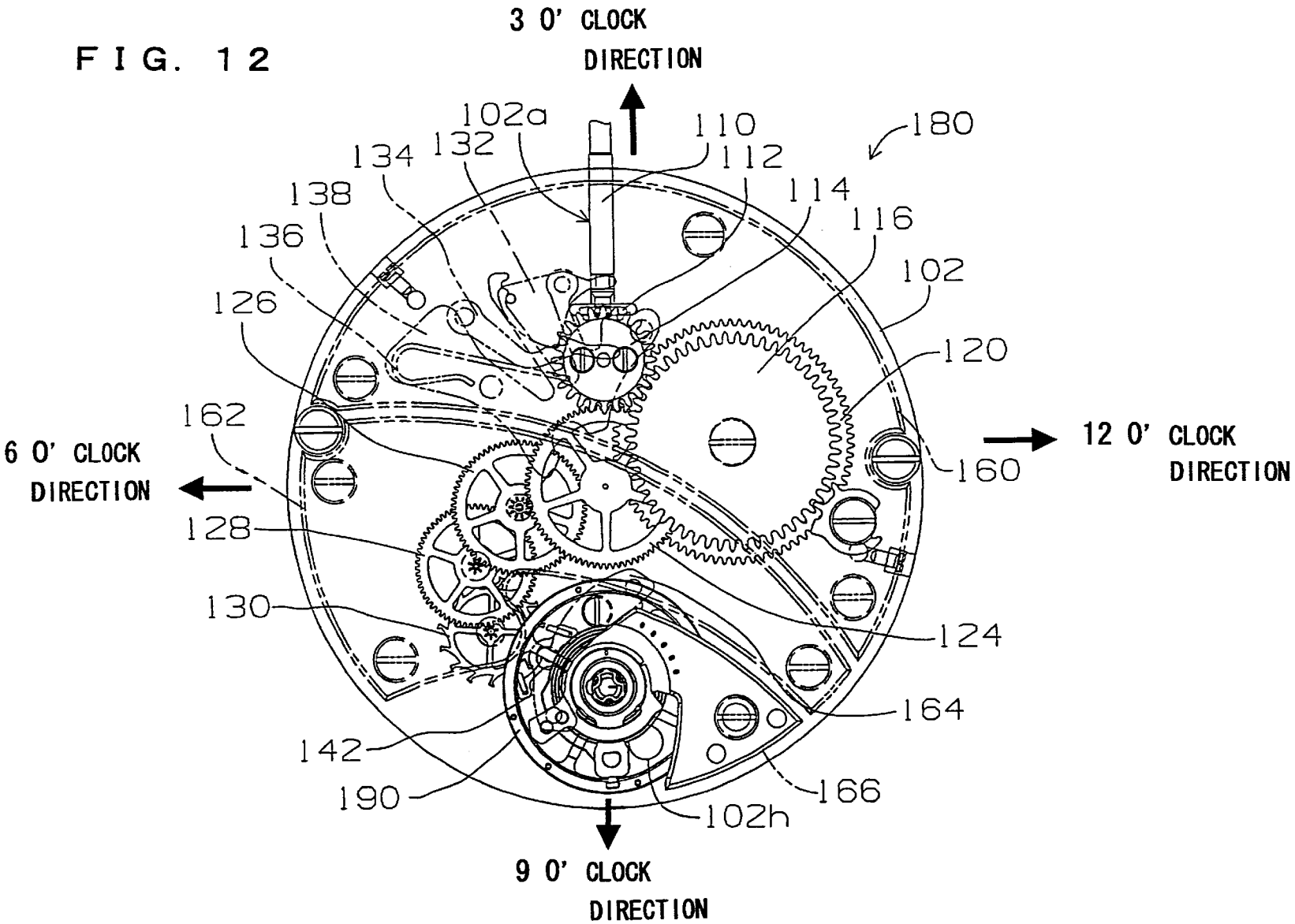
FIG. 12 is a plane view showing an outline shape of a front side of a movement the rate of which has been adjusted by using the rate adjusting method of a mechanical type timepiece according to the invention in a second embodiment of the rate adjusting method of a mechanical type timepiece according to the invention (in FIG. 1 two portions of parts are omitted and bridge members are indicated by imaginary lines).
Figure 13:
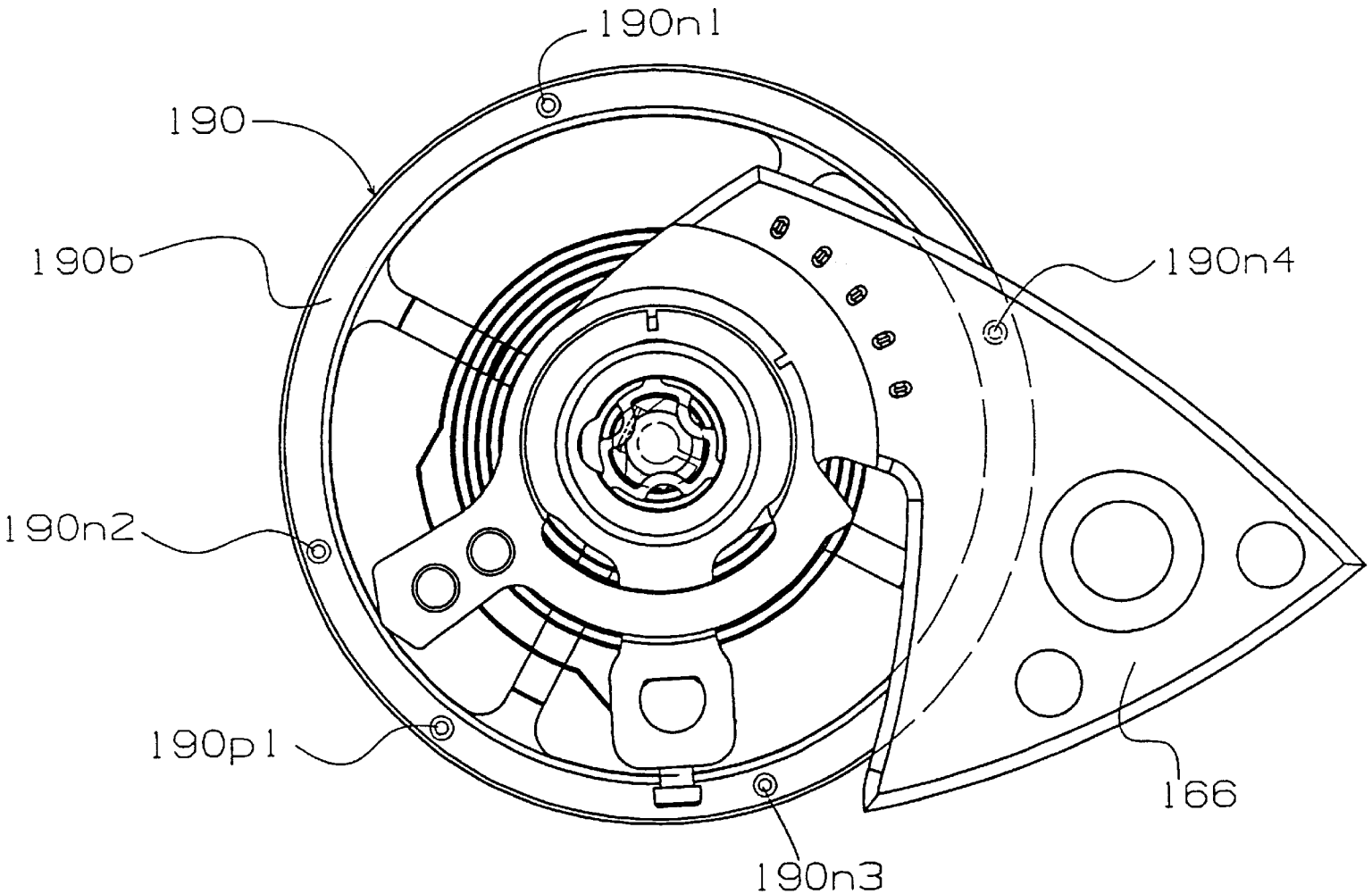
FIG. 13 is a plane view of enlarged portions showing portions of a balance bridge and a balance wheel of a movement in a movement the rate of which has been adjusted by using the rate adjusting method of a mechanical type timepiece according to the invention in the second embodiment of the rate adjusting method of a mechanical type timepiece according to the invention.
Figure 14:
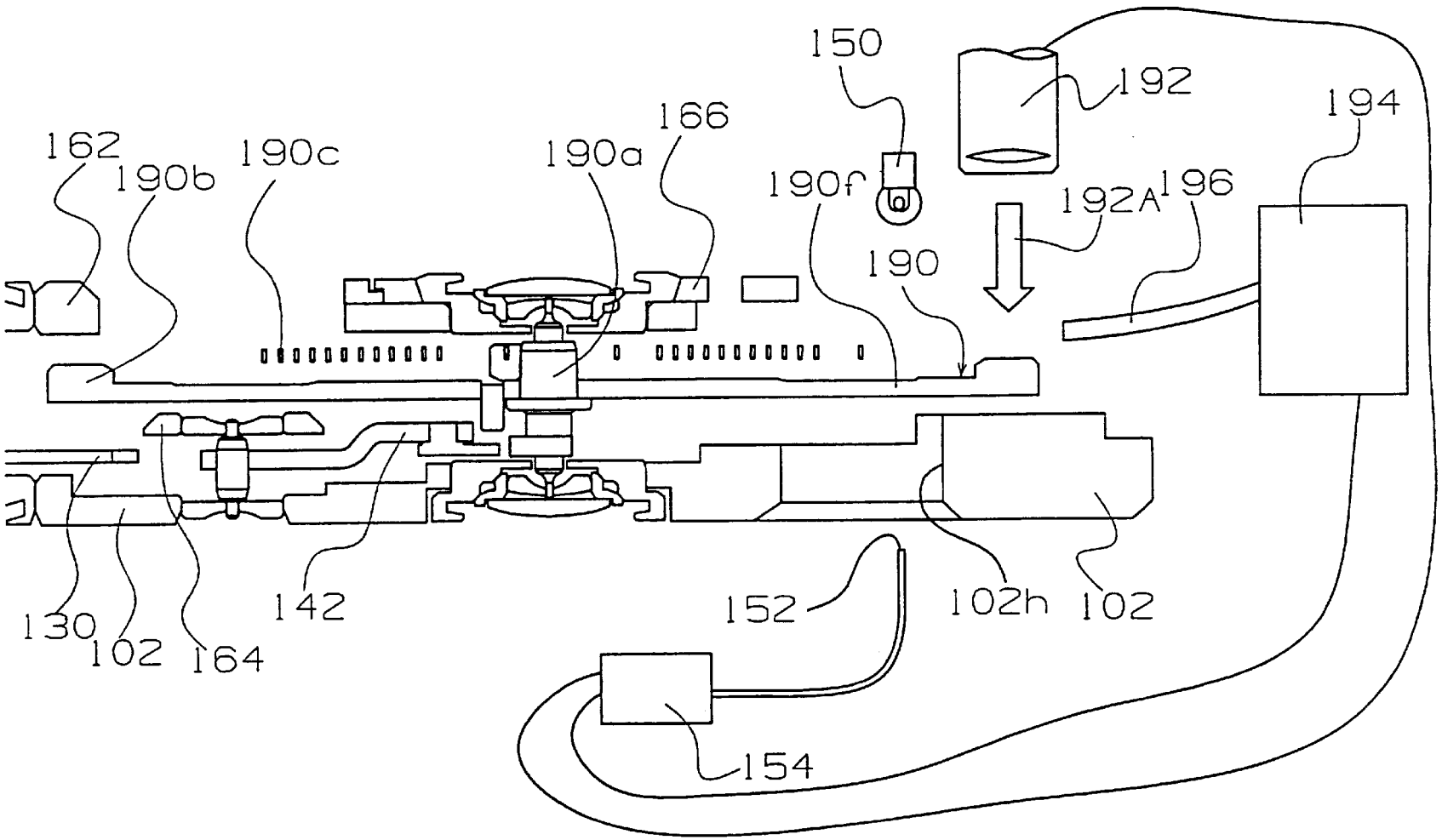
FIG. 14 is a sectional view of the enlarged portions showing the portions of the balance bridge and the balance wheel of the movement the rate of which has been adjusted by using the rate adjusting method of a mechanical type timepiece according to the invention in the second embodiment of the rate adjusting method of a mechanical type timepiece according to the invention.

In reference to FIG. 12 through FIG. 14, according to the second embodiment of the rate adjusting method of the mechanical type timepiece of the invention, firstly, a movement 100 of a mechanical type timepiece is assembled. An escapement & speed control apparatus includes a balance with hairspring 190 repeating alternately right-hand direction and left-hand direction, an escape wheel & pinion 130 rotated based on rotation of a front train wheel and a pallet fork 142 for controlling rotation of the escape wheel & pinion 130 based on operation of the balance with hairspring 190. The balance with hairspring 190 includes a balance stem **190*a*, a balance wheel 190*b* and a hairspring 190*c***.

Next, in a state in which the assembled movement is arranged in "vertical attitude", the rate of the mechanical type timepiece is measured by measuring a state of operating the balance with hairspring 190 with regard to a plurality of attitudes.

Next, when it is necessary to carry out modifying fabrication to the balance wheel by the result of measuring results, the magnitude and the direction of the attitude difference vector are calculated based on the result of measuring rates.

The method of calculating the offset weight amount of the balance with hairspring and the method of calculating the attitude difference vector UB are the same as those in the first embodiment of the rate adjusting method of a mechanical type timepiece according to the invention.

Next, based on the result of calculating the magnitude and the direction of the attitude difference vector, a weight amount to be removed from the balance wheel **190*b* is calculated and a position of the balance wheel 190*b*** to be removed of the weight amount is calculated.

Here, the position of the balance wheel **190*b* to be removed of the weight amount based on the result of calculating the magnitude and the direction of the attitude difference vector, is a position different from the position of the balance wheel 190*b* to be added with the weight amount, mentioned above, by 180 degrees. That is, when the result of calculating the direction of the attitude difference vector remains the same, according to the second embodiment of the rate adjusting method of a mechanical type timepiece of the invention, the position of the balance wheel 190*b* to be removed of the weight amount is disposed at a position constituting point symmetry with the position of the balance wheel 190***b* to be added with the weight amount according to the first embodiment of the rate adjusting method of a mechanical type timepiece according to the invention, mentioned above, with the center of the balance with hairspring as a reference.

In reference to FIG. 14, the light source 150 is arranged to irradiate the balance arm portion 140*f*. The light receiving portion 152 is provided for receiving light of irradiating the balance arm portion 190*f*. Therefore, the balance arm portion 190*f* is operated between the light source 150 and the light receiving portion 152. When the balance arm portion 190*f* is disposed between the light source 150 and the light receiving portion 152, light irradiated from the light source 150 is blocked by the balance arm portion 190*f* and is not incident on the light receiving portion 152. In contrast thereto, when the balance arm portion 190*f* is not present between the light source 150 and the light receiving portion 152, light irradiated from the light source 150 is incident on the light receiving portion 152. The light receiving portion 152 is constituted by, for example, an optical fiber, CCD or a diode or the like.

The light receiving portion 152 is connected to the balance with hairspring operation measuring apparatus 154. The balance with hairspring operation measuring apparatus 154 is provided for calculating the swing angle of the balance with hairspring 190 by measuring operation of the balance arm portion 190*f*.

The balance with hairspring operation measuring apparatus 154 is previously stored with the relationship between the period of light incident on the light receiving portion 152 and the swing angle of the balance with hairspring 190. Therefore, calculation of the swing angle of the balance with the hairspring 190 can be carried out by using the period of light incident on the light receiving portion 152.

Figure 15:
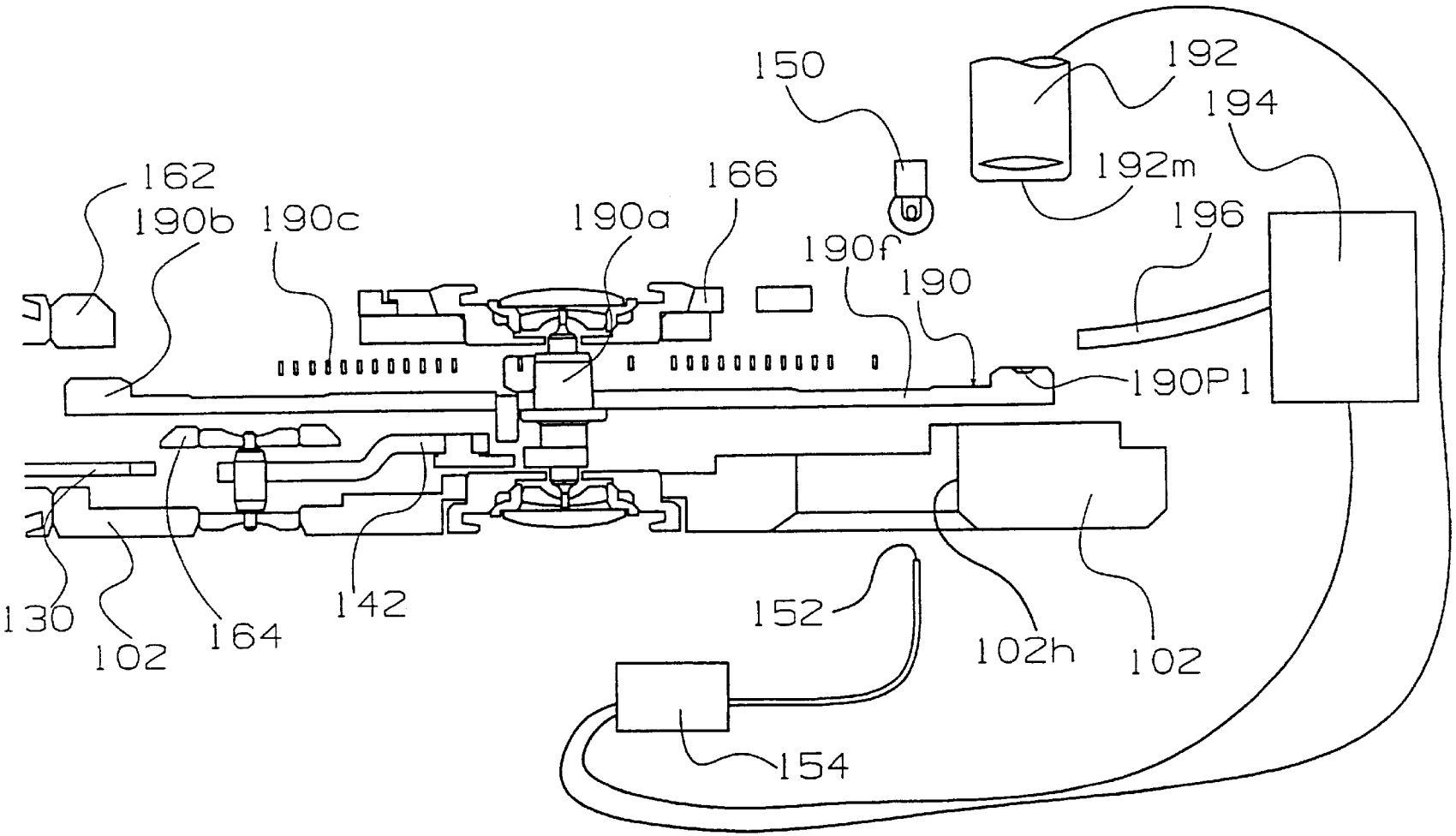
FIG. 15 is a sectional view of the enlarged portions showing the portions of the balance bridge and the balance wheel before adjusting the rate in the second embodiment of the rate adjusting method of a mechanical type timepiece according to the invention.
Figure 16:
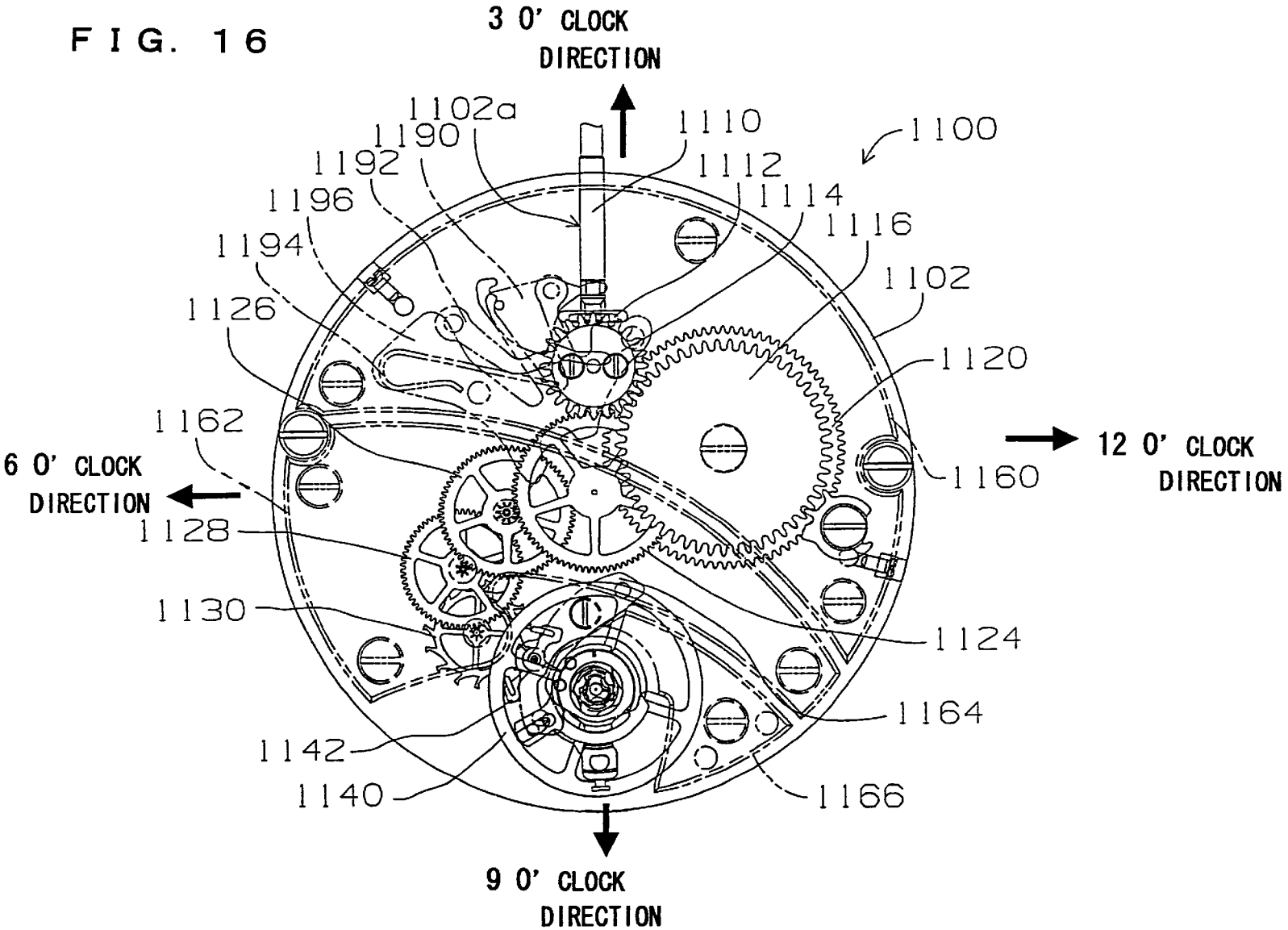
FIG. 16 is a plane view showing an outline shape of a front side of a movement of a conventional mechanical type timepiece (in FIG. 16, portions of parts are omitted and bridge members are indicated by imaginary lines).
Figure 17:
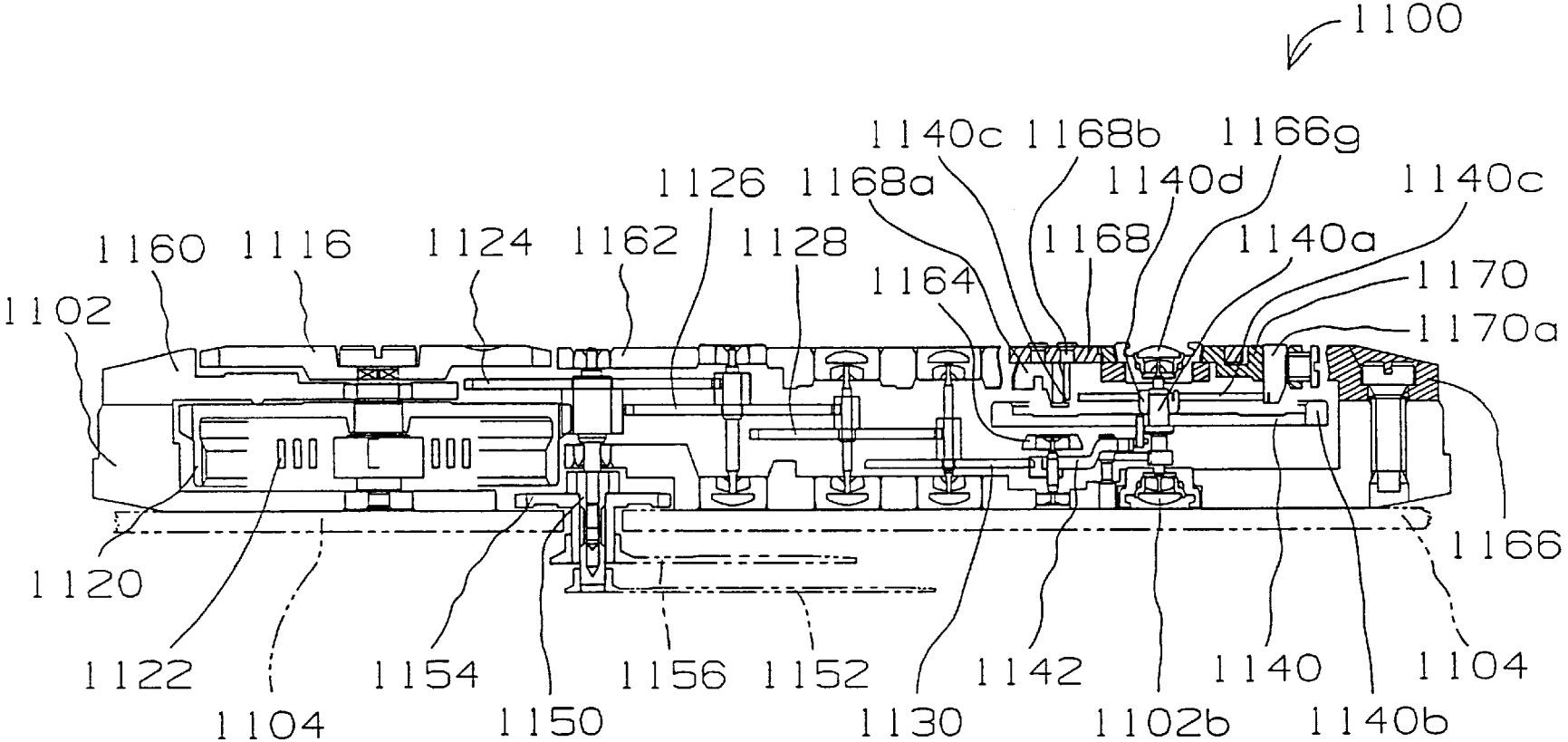
FIG. 17 is an outline sectional view showing the movement of the conventional mechanical type timepiece (in FIG. 17, portions of parts are omitted).

In reference to FIG. 15, a laser emitting apparatus 192 is arranged such that a laser emitting portion 192*n* is opposed to the balance wheel 140*b* to emit laser beam to the surface of the balance wheel 190*b*. The laser emitting apparatus 192 is arranged such that the laser emitting apparatus 192 is connected to the balance with hairspring operation measuring apparatus 154, inputs an operational signal outputted from the balance with hairspring operation measuring apparatus 154 and can emit laser beam to the surface of the balance wheel 190*b*.

When the rate adjustment is determined to be necessary, a weight in correspondence with the result of calculating the offset weight amount is removed from the balance wheel 190*b* by using the laser emitting apparatus 192. There is provided a sucking apparatus 194 for sucking removed debris of the balance wheel 190*b*. A sucking nozzle 196 of the sucking apparatus 194 is arranged such that a front end portion thereof is proximate to the balance wheel 190*b*.

In order to adjust the total adjustment amount of the balance with hairspring, a weight in correspondence with the result of calculating the weight to be removed from four portions of the balance wheel, is removed from four portions of the balance wheel 190*b* spaced apart from each other respectively by 90 degrees.

Here, the method of calculating the weight to be removed from four portions of the balance wheel for adjusting the total adjustment amount of the balance with hairspring is similar to the method of calculating thereof by using Equation (4) in the first embodiment of the rate adjusting method of a mechanical type timepiece according to the invention.

According to the second embodiment of the rate adjusting method of a mechanical type timepiece of the invention, there is included the stage of removing the weight from four portions of the balance wheel and accordingly, the movement is fabricated such that the weight of the balance wheel is heavier than an aimed value in view of design.

In reference to FIG. 13, a portion of the balance with hair spring removed of the weight in correspondence with the result of calculating the offset weight amount of the balance with hairspring from the balance wheel 190*b* is designated by notation 190*p*1.

According to an experiment using the rate adjusting method of a mechanical type timepiece of the invention, the direction of removing the weight in correspondence with the result of calculating the offset weight amount of the balance with hairspring from the balance wheel is about 130 degrees in the example shown in FIG. 13.

Further, portions removed from four portions of the balance wheel for adjusting the total adjustment amount of the balance with hairspring are designated by notations 190*n*1, 190*n*2, 190*n*3 and 190*n*4 (designated by dotted lines).

FIG. 12 shows the movement of the mechanical type timepiece after the rate adjustment has been carried out by the second embodiment of the rate adjusting method of the mechanical type timepiece according to the invention in this way.

Further, according to the second embodiment of the rate adjusting method of a mechanical type timepiece of the invention, portions to be removed from the balance wheel for adjusting the total adjustment amount of the balance with hairspring are four portions constituting point symmetry with the center of the balance wheel as its center, however, portions to be removed from the balance wheel may be a plurality of portions constituting point symmetry with the center of the balance wheel as its center, for example, the portions may be two portions constituting point symmetry with the center of the balance wheel as its center, may be three portions constituting point symmetry with the center of the balance wheel as its center, or the portions may be portions of 4 or more constituting point symmetry with the center of the balance wheel as its center.

Other characteristics of the second embodiment of the rate adjusting method of a mechanical type timepiece according to the invention are similar to characteristics of the first embodiment of the rate adjusting method of a mechanical type timepiece according to the invention, mentioned above. Therefore, with regard to the other characteristics of the second embodiment of the rate adjusting method of a mechanical type timepiece according to the invention, a duplicated description will be avoided by correspondingly applying the description with regard to the first embodiment of the rate adjusting method of a mechanical type timepiece according to the invention.

Even when the second embodiment of the rate adjusting method of a mechanical type timepiece according to the invention is used, there is achieved an effect similar to that in the case of using the first embodiment of the rate adjusting method of a mechanical type timepiece according to the invention, mentioned above.

INDUSTRIAL APPLICABILITY

The rate adjusting method of a mechanical type timepiece according to the invention is suitable for accurately adjusting the rate of the mechanical type timepiece by simple steps without disassembling the movement.

What is claimed is:

1. A rate adjusting method for a mechanical timepiece comprised of a movement having a mainspring constituting a power source for generating a rotational force, a front train wheel for undergoing rotation by a rotational force generated by the mainspring, and an escapement and speed control apparatus for controlling rotation of the front train wheel, the escapement and speed control apparatus having a balance for undergoing reciprocal right-hand rotation and left-hand rotation, an escape wheel and pinion for undergoing rotation in accordance with rotation of the front train wheel, and a pallet fork for controlling rotation of the escape wheel and pinion in accordance with rotation of the balance, the balance having a hairspring, a balance stem and a balance wheel, the rate adjusting method comprising the steps of:

assembling the movement of the mechanical timepiece;

disposing the assembled movement in a vertical position and measuring rates with respect to a plurality of vertical attitudes of the assembled movement;

calculating the magnitude and direction of an attitude difference vector in accordance with the measured rates;

calculating a weight amount to be added to or subtracted from the balance wheel and calculating a position on the balance wheel where the amount of weight is to be added or to be subtracted in accordance with the calculated magnitude and direction of the attitude difference vector; and adding to or subtracting from the calculated position of the balance wheel the amount of weight in accordance with the calculated weight amount and the calculated position on the balance wheel.

2. A rate adjusting method according to claim 1; wherein the step of measuring rates with respect to a plurality of vertical attitudes comprises measuring rates with respect to an attitude of 12 o'clock upper, an attitude of 3 o'clock upper, an attitude of 6 o'clock upper, and an attitude of 9 o'clock upper.

3. A rate adjusting method according to claim 1; wherein the steps of calculating a weight amount to be added to or subtracted from the balance wheel and calculating a position on the balance wheel where the weight amount is to be added or subtracted comprises calculating the weight amount to be added to the balance wheel and calculating the position on the balance wheel where the weight mount is to be added; and wherein the step of adding to or subtracting from the calculated position of the balance wheel the weight amount comprises adding the weight mount by attaching the weight amount on a surface of the balance wheel using an ink jet projecting apparatus.

4. A rate adjusting method according to claim 1; wherein the steps of calculating a weight amount to be added to or subtracted from the balance wheel and calculating a position on the balance wheel where the weight amount is to be added or subtracted comprises calculating the weight amount to be subtracted from the balance wheel and calculating the position on the balance wheel where the weight mount is to be subtracted from; and wherein the step of adding to or subtracting from the calculated position of the balance wheel the weight amount comprises subtracting the weight amount from the balance wheel by removing the night amount using a laser emitting apparatus.

5. A rate adjusting method according to claim 1; wherein the step of calculating the magnitude and direction of an attitude difference vector comprises calculating the magnitude and direction of an attitude difference vector with respect to a plurality of swing angles of the balance.

6. A rate adjusting method according to claim 5; wherein the step of calculating the magnitude and direction of an attitude difference vector with respect to a plurality of swing angles of the balance comprises calculating the attitude difference vector using the equation $$UB=_{+e,rad\ (Htw-Hsi)}{}^{2}+(Hth-Hni)^{2}+ee\ ,$$

where UB represents the attitude difference vector, Htw represents the rate of attitude of 12 o'clock upper, Hth represents the rate of attitude of 3 o'clock upper, Hsi represents the rate of attitude of 6 o'clock upper, and Hni represents the rate of attitude of 9 o'clock upper, calculating an offset weight amount of the balance wheel and a position on the balance wheel for attaching ink using the equation $$UB = \frac{m^{*}r^{*}Kb}{I},$$

where UB represents the attitude difference vector, m represents the offset weight amount of the balance wheel, r represents the position of the balance wheel on which the ink is attached as a distance from a center of balance wheel, Kb represents the total number of oscillations of the balance in 24 hours, and I represents the moment of inertia of the balance wheel, and calculating an attitude difference vector direction of the attitude difference vector UB using the equation $$DUB = \tan^{-1}\frac{Htw - Hsi}{Hth - Hni}.$$

7. A rate adjusting method according to claim 2; wherein the steps of calculating a weight amount to be added to or subtracted from the balance wheel and calculating a position on the balance wheel where the weight amount is to be added or subtracted comprises calculating the weight amount to be added to the balance wheel and calculating the position on the balance wheel where the weight amount is to be added; and wherein the step of adding to or subtracting from the calculated position of the balance wheel the night amount comprises adding the weight amount by attaching the weight amount on a surface of the balance wheel using an ink jet projecting apparatus.

8. A rate adjusting method according to claim 2; wherein the steps of calculating a weight amount to be added to or subtracted from the balance wheel and calculating a position on the balance wheel where the weight amount is to be added or subtracted comprises calculating the weight amount to be subtracted from the balance wheel and calculating the position on the balance wheel where the weight amount is to be subtracted from; and wherein the step of adding to or subtracting from the calculated position of the balance wheel the weight amount comprises subtracting the weight amount from the balance wheel by removing the weight amount using a laser emitting apparatus.

9. A rate adjusting method according to claim 2; wherein the step of calculating the magnitude and direction of an attitude difference vector comprises calculating the magnitude and direction of an attitude difference vector with respect to a plurality of swing angles of the balance.

10. A rate adjusting method according to claim 9; wherein the step of calculating the magnitude and direction of an attitude difference vector with respect to a plurality of swing angles of the balance comprises calculating the attitude difference vector using the equation $$UB=_{+e,rad\ (Htw-Hsi)}{}^{2}+(Hth-Hni)^{2}+ee\ ,$$

where UB represents the attitude difference vector, Htw represents the rate of attitude of 12 o'clock upper, Hth represents the rate of attitude of 3 o'clock upper, Hsi represents the rate of attitude of 6 o'clock upper, and Hni represents the rate of attitude of 9 o'clock upper, calculating an offset night amount of the balance wheel and a position on the balance wheel for attaching ink using the equation $$UB = \frac{m^{*}r^{*}Kb}{I},$$

where UB represents the attitude difference vector, m represents the offset weight amount of the balance wheel, r represents the position of the balance wheel on which the ink is attached as a distance from a center of balance wheel, Kb represents the total number of oscillations of the balance in 24 hours, and I represents the moment of inertia of the balance wheel, and calculating an attitude difference vector direction of the attitude difference vector UB using the equation $$DUB = \tan^{-1}\frac{Htw - Hsi}{Hth - Hni}.$$

11. A rate adjusting method according to claim 3; wherein the step of calculating the magnitude and direction of an attitude difference vector comprises calculating the magnitude and direction of an attitude difference vector with respect to a plurality of swing angles of the balance.

12. A rate adjusting method according to claim 11; wherein the step of calculating the magnitude and direction of an attitude difference vector with respect to a plurality of swing angles of the balance comprises calculating the attitude difference vector using the equation $$UB=_{+e,rad\ (Htw-Hsi)}{}^{2}+(Hth-Hni)^{2}+ee\ ,$$

where UB represents the attitude difference vector, Htw represents the rate of attitude of 12 o'clock upper, Hth represents the rate of attitude of 3 o'clock upper, Hsi represents the rate of attitude of 6 o'clock upper, and Hni represents the rate of attitude of 9 o'clock upper, calculating an offset weight amount of the balance wheel and a position on the balance wheel for attaching ink using the equation $$UB = \frac{m^{*}r^{*}Kb}{I},$$

where UB represents the attitude difference vector, m represents the offset weight amount of the balance wheel, r represents the position of the balance wheel on which the ink is attached as a distance from a center of balance wheel, Kb represents the total number of oscillations of the balance in 24 hours, and I represents the moment of inertia of the balance wheel, and calculating an attitude difference vector direction of the attitude difference vector UB using the equation $$DUB = \tan^{-1}\frac{Htw - Hsi}{Hth - Hni}.$$

13. A rate adjusting method according to claim 4; wherein the step of calculating the magnitude and direction of an attitude difference vector comprises calculating the magnitude and direction of an attitude difference vector with respect to a plurality of swing angles of the balance.

14. A rate adjusting method according to claim 9; wherein the step of calculating the magnitude and direction of an attitude difference vector with respect to a plurality of swing angles of the balance comprises calculating the attitude difference vector using the equation $$UB=_{+e,rad\ (Htw-Hsi)}{}^{2}+(Hth-Hni)^{2}+ee\ ,$$

where UB represents the attitude difference vector, Htw represents the rate of attitude of 12 o'clock upper, Hth represents the rate of attitude of 3 o'clock upper, Hsi represents the rate of attitude of 6 o'clock upper, and Hni represents the rate of attitude of 9 o'clock upper, calculating an offset weight amount of the balance wheel and a position on the balance wheel for attaching ink using the equation $$UB = \frac{m^{*}r^{*}Kb}{I},$$

where UB represents the attitude difference vector, m represents the offset weight amount of the balance wheel, r represents the position of the balance wheel on which the ink is attached as a distance from a center of balance wheel, Kb represents the total number of oscillations of the balance in 24 hours, and I represents the moment of inertia of the balance wheel, and calculating an attitude difference vector direction of the attitude difference vector UB using the equation $$DUB = \tan^{-1}\frac{Htw - Hsi}{Hth - Hni}.$$

* * * * *